US007145524B2

(12) United States Patent
Sakita

(10) Patent No.: US 7,145,524 B2
(45) Date of Patent: Dec. 5, 2006

(54) METHOD FOR DRIVING PLASMA DISPLAY PANEL

(75) Inventor: Koichi Sakita, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 499 days.

(21) Appl. No.: 10/765,854

(22) Filed: Jan. 29, 2004

(65) Prior Publication Data

US 2004/0189549 A1 Sep. 30, 2004

(30) Foreign Application Priority Data

Mar. 31, 2003 (JP) ..... 2003-095003

(51) Int. Cl.
*G09G 3/28* (2006.01)

(52) U.S. Cl. ..... 345/60; 345/62; 345/67; 315/169.4

(58) Field of Classification Search ..... 345/60–69, 345/204, 208–210; 313/586, 484; 348/797–799; 315/169.3, 169.4
See application file for complete search history.

(56) References Cited

U.S. PATENT DOCUMENTS 5,745,086 A 4/1998 Weber
6,580,227 B1 * 6/2003 Kobayashi ..... 315/169.4

* cited by examiner

*Primary Examiner*—Lun-yi Lao
(74) *Attorney, Agent, or Firm*—Staas & Halsey LLP

(57) ABSTRACT

A method for driving a plasma display panel is provided in which a wall voltage at an interelectrode between a display electrode and an address electrode is controlled without increasing contrast in preparation for addressing, so that reliability of addressing is improved. As an operation of initialization for controlling the wall voltage of a cell within a screen as a preparation for the addressing, a first blunt wave application is performed for generating discharge only in a previous non-lighted cell that was not lighted in a previous display, and a second blunt wave application is performed for generating discharge in each of the previous non-lighted cell and a previous lighted cell that was lighted in the previous display.

6 Claims, 18 Drawing Sheets

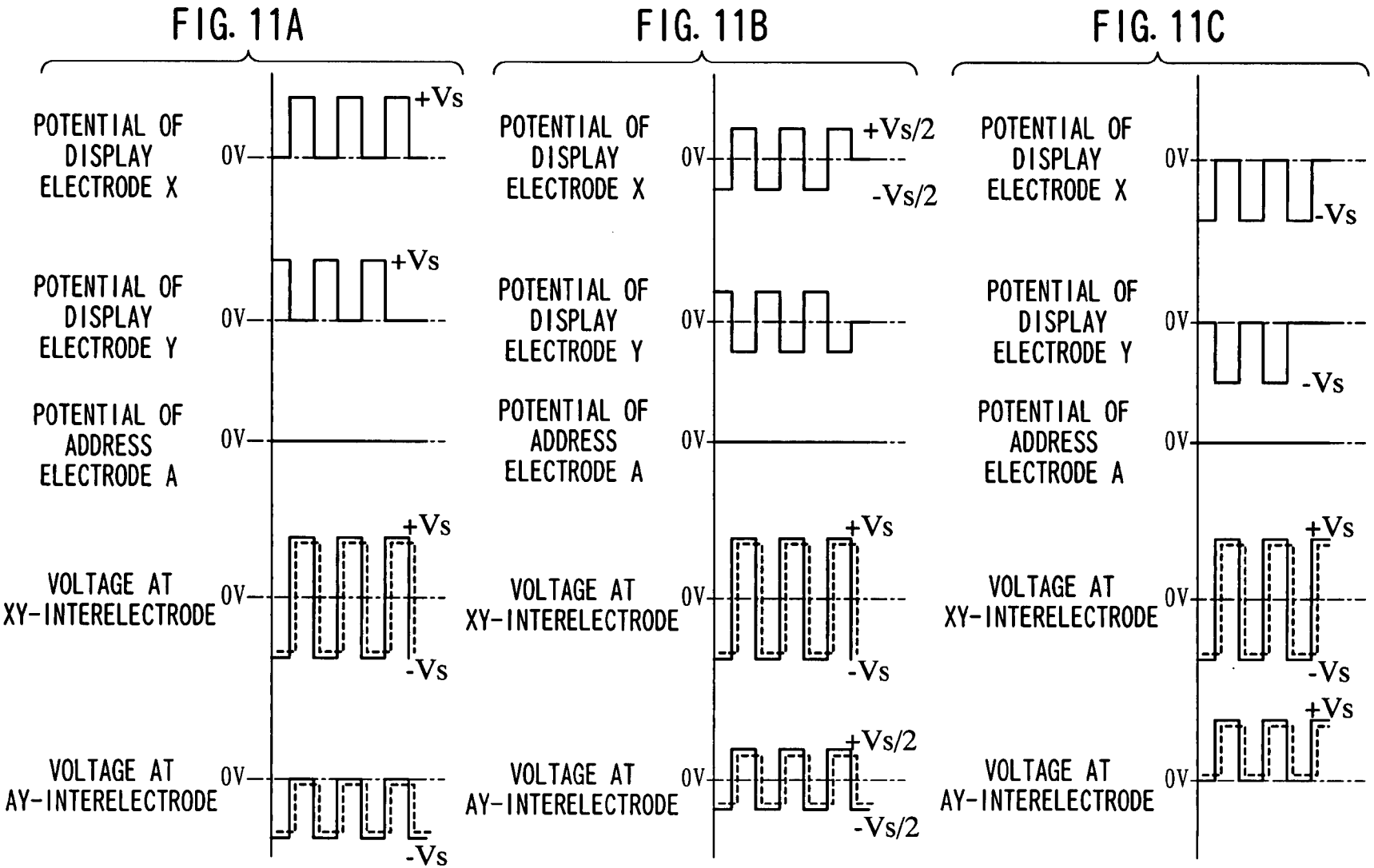
FIG. 11A
POTENTIAL OF DISPLAY ELECTRODE X
POTENTIAL OF DISPLAY ELECTRODE Y
POTENTIAL OF ADDRESS ELECTRODE A
VOLTAGE AT XY-INTERELECTRODE
VOLTAGE AT AY-INTERELECTRODE
0V
+Vs
-Vs
FIG. 11B
POTENTIAL OF DISPLAY ELECTRODE X
POTENTIAL OF DISPLAY ELECTRODE Y
POTENTIAL OF ADDRESS ELECTRODE A
VOLTAGE AT XY-INTERELECTRODE
VOLTAGE AT AY-INTERELECTRODE
0V
+Vs/2
-Vs/2
+Vs
-Vs
FIG. 11C
POTENTIAL OF DISPLAY ELECTRODE X
POTENTIAL OF DISPLAY ELECTRODE Y
POTENTIAL OF ADDRESS ELECTRODE A
VOLTAGE AT XY-INTERELECTRODE
VOLTAGE AT AY-INTERELECTRODE
0V
-Vs
+Vs

METHOD FOR DRIVING PLASMA DISPLAY PANEL

BACKGROUND OF THE INVENTION

1. Field of the Invention

The present invention relates to a method for driving a plasma display panel (PDP), which is suitable for driving a surface discharge AC type PDP. This surface discharge type has a pair of display electrodes arranged in parallel on a front substrate or a back substrate. The display electrodes become an anode and a cathode in display discharge for securing luminance. One of tasks to be solved for an AC type plasma display panel is light emission in an area that is not to be lighted in a screen, i.e., background light emission.

2. Description of the Prior Art

FIG. 1 shows a cell structure of a typical surface discharge type plasma display panel. A PDP 1 includes a pair of body structures (having a substrate and cell elements arranged on the substrate). A front substrate body structure includes a glass substrate 11, and display electrodes X (first display electrodes) and display electrodes Y (second display electrodes) are arranged on the inner surface of the glass substrate 11 so that a pair of display electrode X and display electrode Y corresponds to one row of the matrix display. Each of the display electrodes X and Y includes a transparent conductive film 41 that forms a surface discharge gap and a metal film 42 that is overlaid on the end rim portion of the transparent conductive film 41, which are covered with a dielectric layer 17 made of a low melting point glass and a protection film 18 made of magnesia. A back substrate body structure includes a glass substrate 21, and address electrodes A are arranged on the inner surface of the glass substrate 21 so that one address electrode A corresponds to one column. Each of the address electrodes A is covered with a dielectric layer 24, on which partitions 29 are disposed for dividing a discharge space into plural spaces corresponding to columns. A surface of the dielectric layer 24 and side faces of the partitions 29 are covered with fluorescent material layers 28R, 28G and 28B for a color display. Italic letters (R, G and B) in FIG. 1 denote light emission colors of the fluorescent materials. The colors are arranged in a repeating pattern of R, G and B in which cells of the same column have the same color. The fluorescent material layers 28R, 28G and 28B are excited locally by ultraviolet rays that are emitted by a discharge gas so as to emit light. A structure at an intersection point of a row and a column is a cell, and three cells constitute one pixel of a display image. Since the cell is a binary light emission element, it is required to control integral light emission quantity of each cell for each frame in order to display a color image.

FIG. 2 shows an example of frame division for a color display. The color display is one type of gradation display, and a display color is determined by a combination of three luminance values of red, green and blue colors. The gradation display is realized by a method in which one frame is made up of plural subframes that have weights of luminance values. In FIG. 2, one frame is made up of eight subframes (each subframe is abbreviated as SF in FIG. 2 and following explanation). When a ratio of the integral light emission quantity of these SFs, i.e., a ratio of weights of luminance values is set equal to or nearly equal to 1:2:4:8:16:32:64:128, $2^8$ (=256) gradation levels can be reproduced. For example, in order to reproduce a gradation level 10, cells are lighted in SF2 of weight 2 and SF4 of weight 8 while cells are not lighted in the other SFs.

An initialization period, an address period and a sustaining period are assigned to each SF. An initialization process is performed during an initialization period for equalizing wall voltages in all cells, and addressing process is performed during an address period for controlling the wall voltage of each cell in accordance with display data. Then, a sustaining process is performed during a sustaining period for generating display discharge only in cells to be lighted. One frame is displayed by repeating the initialization process, the addressing process and the sustaining process. However, contents of the addressing are usually different for each subframe. In addition, a length of the sustaining period is not fixed but changes corresponding to the weight of luminance.

FIG. 3 shows conventional driving waveforms. FIG. 3 shows generally the waveforms for the address electrode A and the display electrode X. Furthermore, FIG. 3 shows waveforms for the display electrode Y(1) of the first line and the display electrode Y(n) of the last line as representatives.

A positive blunt wave is applied to the display electrode Y during the initialization period. Namely, a bias control is performed so as to increase a potential of the display electrode Y simply. In order to accelerate reaching a predetermined potential, a positive offset bias is applied to the display electrode Y while a negative offset bias is applied to the display electrode X. After that, a negative blunt wave is applied to the display electrode Y. Namely, a bias control is performed in which a potential of the display electrode Y is decreased simply. A potential of the address electrode A is maintained at the ground level (0 volt) during the entire initialization period. A scan pulse is applied to each display electrode Y one by one during the address period. Namely, a row selection is performed. In synchronization with the row selection, an address pulse is applied to the address electrode A that corresponds to the cell to be lighted in the selected row. Address discharge is generated in the cell to be lighted that is selected by the display electrode Y and the address electrode A, so that predetermined wall charge is formed in the cell. A positive sustaining pulse is applied alternately to the display electrode Y and the display electrode X during the sustaining period. The display discharge is generated between the display electrodes (hereinafter referred to as XY-interelectrode) of the cell to be lighted by every application.

When the initialization period starts, i.e., when the sustaining period ends in the SF prior to the noted SF (hereinafter referred to as the previous SF), there are cells that have relatively much wall charge remained and cells that do not have. A lot of wall charge is remained in cells that were lighted correctly in the previous SF (hereinafter referred to as a "previous lighted cell"), while little wall charge is remained in cells that were kept in the non-lighted state correctly in the previous SF (hereinafter referred to as a "previous non-lighted cell"). Here, "correctly" means "in accordance with display data". If the addressing process is performed in the state where charge quantity is different between cells, an error of generating address discharge in cells that are not to be lighted may occur easily. As a preparation process for improving reliability of the addressing process, the initialization process is important.

As explained above, the initialization in which the blunt wave is applied two times is effective for realizing the addressing process that is hardly affected by the influence of variation in the discharge characteristics between cells. The U.S. Pat. No. 5,745,086 discloses a method of decreasing the difference of wall voltages between the previous lighted cell and the previous non-lighted cell by applying the blunt wave the first time and equalizing the wall voltage of all cells to a predetermined value by applying the blunt wave the second time.

As being explained below, the initialization is performed so as to generate so-called microdischarge in the previous lighted cell as well as the previous non-lighted cell by each of the first application and the second application of the blunt wave in the conventional method.

FIGS. 4A and 4B show waveforms of voltage variation in the conventional initialization process. FIG. 4A corresponds to a part of the initialization period in FIG. 3. The potential of the display electrode Y increases from $V_Y$1' to $V_Y$1 gently by the application of a positive blunt wave and then decreases from $V_Y$2' to $-V_Y$2 gently by the application of a negative blunt wave. The word "gently" means that pulse discharge such as display discharge is not generated. At the start point of the application of the negative blunt wave, the offset bias to the display electrode X is switched from $-V_X$1 to $V_X$2.

For the consideration of discharge among three electrodes in a cell having a three-electrode structure, it is effective to pay attention to the XY-interelectrode and an AY-interelectrode (an interelectrode between an address electrode A and a display electrode Y). FIG. 4B shows variations of an applied voltage and a wall voltage at these two interelectrodes. The variation of the applied voltage is shown by a continuous line while the variation of the wall voltage is shown by a dotted line. However, it should be noted that the wall voltage is shown with positive and negative polarities inverted.

A state of a cell can be described by a cell voltage at the XY-interelectrode and a cell voltage at the AY-interelectrode. The cell voltage is a sum of the applied voltage and the wall voltage at each interelectrode. Since a polarity of the wall voltage is inverted in FIG. 4B, the distance between the dotted line and the continuous line indicates a value of the cell voltage at the corresponding interelectrode in the drawing. When the continuous line is above the dotted line, the cell voltage has the positive polarity. When the continuous line is below the dotted line, the cell voltage has the negative polarity.

In the discharge generated by the application of a blunt wave, a discharge start threshold level is an important parameter. Each electrode can be an anode or a cathode in the discharge at three interelectrodes, so there is a difference of discharge characteristics between the cases. Therefore, six discharge start threshold levels are defined as follows.

$Vt_{XY}$: a discharge start threshold level at the XY-interelectrode when the display electrode Y is a cathode $Vt_{YX}$: a discharge start threshold level at the XY-interelectrode when the display electrode X is a cathode $Vt_{AY}$: a discharge start threshold level at the AY-interelectrode when the display electrode Y is a cathode $Vt_{YA}$: a discharge start threshold level at the AY-interelectrode when the address electrode A is a cathode $Vt_{AX}$: a discharge start threshold level at the AX-interelectrode when the display electrode X is a cathode $Vt_{XA}$: a discharge start threshold level at the AX-interelectrode when the address electrode A is a cathode Here, the AX-interelectrode is an interelectrode between the address electrode A and the display electrode X.

FIG. 5 shows an example of a cell operation in the conventional initialization process. The wall voltage variation in the previous lighted cell is shown by a broken line, while the wall voltage variation in the previous non-lighted cell is shown by a dotted line. At the time tO just before the initialization, the wall voltage in the previous lighted cell has the negative polarity at the XY-interelectrode as well as at the AY-interelectrode (since the polarity is inverted, the dotted line and the broken line above the line that indicates zero volt correspond to negative wall voltages). On the other hand, the wall voltage in the previous non-lighted cell has the positive polarity at the XY-interelectrode as well as at the AY-interelectrode (note that the polarities are inverted).

When the first application of the blunt wave starts in the initialization process, the cell voltage increases. Since the previous lighted cell is charged more than the previous non-lighted cell, discharge at the XY-interelectrode starts in the previous lighted cell at the time t1 that is earlier than in the previous non-lighted cell. Once the discharge starts, electrification of the wall charge begins so as to keep the cell voltage at the discharge start threshold level $Vt_{YX}$, and a wall voltage is generated corresponding to the charge quantity (hereinafter, this phenomenon is expressed as "a wall voltage is written"). On this occasion, the wall voltage at the AY-interelectrode also changes simultaneously. However, the rate of the variation is smaller than that of the applied voltage to the AY-interelectrode, so the absolute value of the cell voltage at the AY-interelectrode increases. Discharge starts in the previous non-lighted cell at the time t2 when a certain period has passed after the start of the discharge in the previous lighted cell. Also in the previous non-lighted cell, a wall voltage is written so as to maintain the cell voltage at the discharge start threshold level $Vt_{YX}$.

In the example shown in FIG. 5, the cell voltage at the AY-interelectrode does not exceed the discharge start threshold level even after the application of the negative blunt wave is finished. Therefore, discharge that controls the cell voltage at the AY-interelectrode is not generated. A value of the wall voltage at the XY-interelectrode is $V_{XY}$1$-Vt_{YX}$ at the time t3 when the application of the negative blunt wave is finished. On the contrary, the wall voltage at the AY-interelectrode is not fixed.

Then the second application of the blunt wave starts. As the applied voltages at the XY-interelectrode and at the AY-interelectrode increase, the cell voltage also increases. The cell voltage at the XY-interelectrode exceeds the discharge start threshold level $Vt_{XY}$ at the time t4. After the time t4, the wall voltage at the XY-interelectrode is written so as to keep the cell voltage at the XY-interelectrode at the discharge start threshold level $Vt_{XY}$. At the same time, the wall voltage at the AY-interelectrode is also written. However, since the wall voltage variation at the AY-interelectrode is smaller than that of the applied voltage, an absolute vale of the cell voltage at the AY-interelectrode increases.

In the example shown in FIG. 5, amplitude (a target voltage) of the blunt wave is small, and the cell voltage at the AY-interelectrode does not exceed the discharge start threshold level $Vt_{AY}$. A value of the wall voltage at the XY-interelectrode is a predetermined value $V_{XY}$2$-Vt_{XY}$ at the time t5 when the initialization process is finished. On the contrary, the wall voltage at the AY-interelectrode is not fixed.

The conventional driving method has a problem that an address discharge error can be generated when the wall voltage at the AY-interelectrode is not controlled in the initialization process. The wall voltage at the AY-interelectrode can be controlled in the same way as the wall voltage at the XY-interelectrode in the conventional driving method by increasing the applied voltage for the second application of the blunt wave. However, if the applied voltage is increased, discharge may start early in the previous non-lighted cell responding to the first application of the blunt wave. As a result, a light emission period of the previous non-lighted cell may be lengthened. Accordingly, background light emission may increase, and display contrast may be lowered. In addition, if the applied voltage is increased, requirement of a withstanding voltage for components of a driving circuit may become stricter resulting in a cost increase of the driving circuit. It is very difficult to determine a lower limit of write quantity of the wall voltage in the previous non-lighted cell while controlling complicated discharge in the three-electrode structure.

SUMMARY OF THE INVENTION

An object of the present invention is to provide a method for driving a plasma display panel that controls the wall voltage at an interelectrode between a display electrode and an address electrode without increasing contrast in preparation of an addressing process, so that reliability of the addressing is improved. Another object is to shorten a time period that is necessary for preparing for the addressing step.

According to one aspect of the present invention, the method includes applying a first blunt wave for controlling a wall voltage as a preparation for an addressing process so as to generate discharge only in previous non-lighted cells, and applying a second blunt wave so as to generate discharge in the previous non-lighted cells as well as in the previous lighted cell. In order not to generate discharge in the previous lighted cells in the application of the first blunt wave, the wall voltage in the previous lighted cell is changed by applying a rectangular waveform before applying the first blunt wave.

BRIEF DESCRIPTION OF THE DRAWINGS

FIGS. 11A–11C are diagrams showing relationships between a typical sustaining pulse waveform and a wall voltage in a lighted cell.

DESCRIPTION OF THE PREFERRED EMBODIMENTS

Hereinafter, the present invention will be explained more in detail with reference to embodiments and drawings.

[Explanation of a Cell Voltage Plane]

Figure 6:
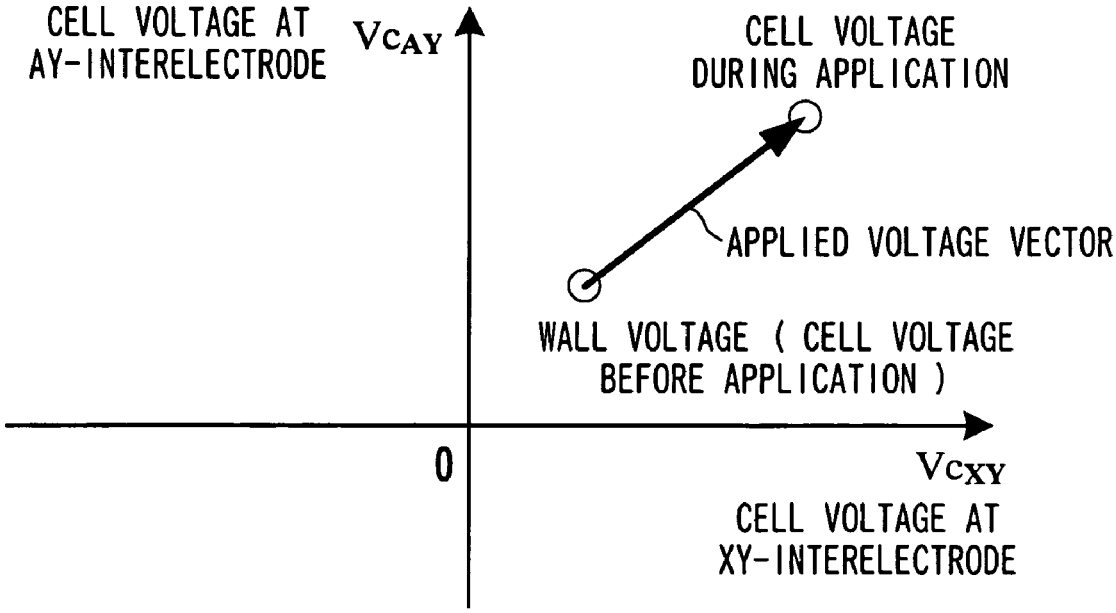
FIG. 6 is an explanatory diagram of a cell voltage plane.

An operation of a plasma display panel having a three-electrode structure can be analyzed in a geometric manner by using a cell voltage plane and a discharge start threshold level closed curve that were disclosed in an international conference, Society for Information Display held in 2001. Noting a set of an XY-interelectrode and an AY-interelectrode, a cell voltage, a wall voltage and an applied voltage are-expressed as two-dimensional voltage vectors, i.e., a cell voltage vector ($Vc_{XY}$, $Vc_{AY}$), a wall voltage vector ($Vw_{XY}$, $Vw_{AY}$) and an applied voltage vector ($Va_{XY}$, $Va_{AY}$). Then, as shown in FIG. 6, a coordinates plane is defined in which the horizontal axis corresponds to a cell voltage $Vc_{XY}$ at the XY-interelectrode, while the vertical axis corresponds to a cell voltage $Vc_{AY}$ at the AY-interelectrode. This is called a cell voltage plane. In the cell voltage plane, the relationship among the above-mentioned three vectors is schematized by dots and arrows. The cell voltage points that are located on a plane indicate values of cell voltages at the XY-interelectrode and the AY-interelectrode. Since the cell voltage when the applied voltage is zero is equal to the wall voltage, a cell voltage point corresponding to this state is called a "wall voltage point". When a voltage is applied to a cell or when a wall voltage is changed, the cell voltage point moves by a distance that corresponds to the applied voltage or to a variation of the wall voltage. This movement is indicated by the arrow as a two-dimensional vector.

[Explanation of a Vt Closed Curve]

Figure 7:
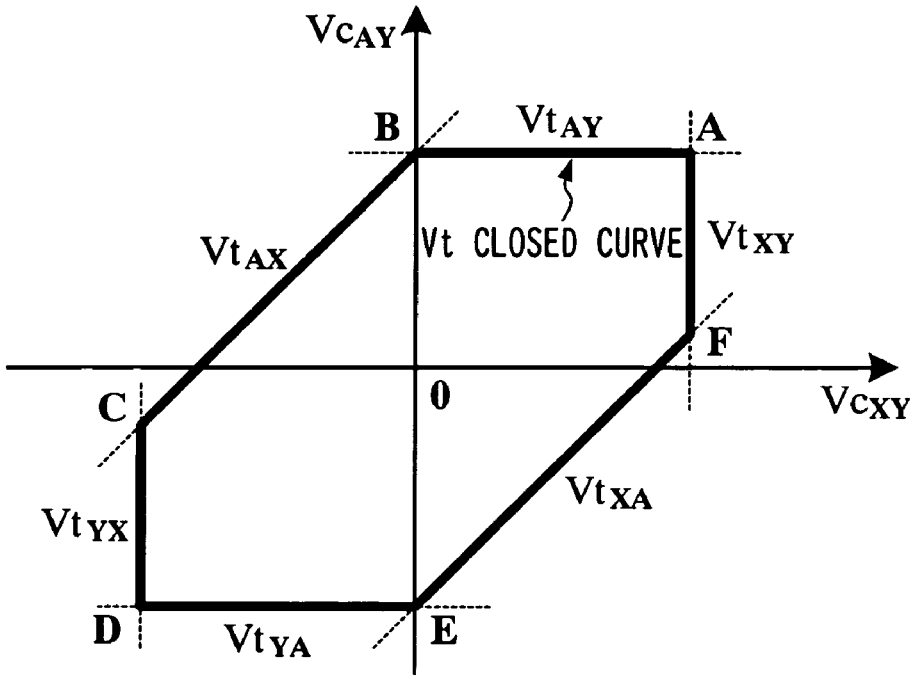
FIG. 7 is an explanatory diagram of a Vt closed curve.

FIG. 7 is an explanatory diagram of a Vt closed curve. The discharge start threshold levels $Vt_{XY}$, $Vt_{YX}$, $Vt_{AY}$, $Vt_{YA}$, $Vt_{AX}$ and $Vt_{XA}$ that are defined as explained above are important in the initialization process that is a preparation for the addressing process. When discharge start threshold level points are plotted on the cell voltage plane, a hexagon appears. This hexagon is a "discharge start threshold level closed curve". Hereinafter, this is called the "Vt closed curve". The Vt closed curve indicates a voltage range in which discharge is generated. The wall voltage point, i.e., the cell voltage point in the state where discharge is stopped is always located within the Vt closed curve. Each of the six sides AB, BC, CD, DE, EF and FA in the Vt closed curve shown in FIG. 7 corresponds to discharge at one interelectrode as follows.

The side AB: AY discharge (discharge at the AY-interelectrode) in which the display electrode Y is a cathode The side BC: AX discharge (discharge at the AX-interelectrode) in which the display electrode X is a cathode The side CD: XY discharge (discharge at the XY-interelectrode) in which the display electrode X is a cathode The side DE: AY discharge in which the address electrode A is a cathode The side EF: AX discharge in which the address electrode A is a cathode The side FA: XY discharge in which the display electrode Y is a cathode In addition, each of the six vertices A, B, C, D, E and F is a point that satisfies two discharge start threshold levels simultaneously (that is called a "simultaneous discharge point") and corresponds to simultaneous discharge of one of the following combinations.

Figure 8:
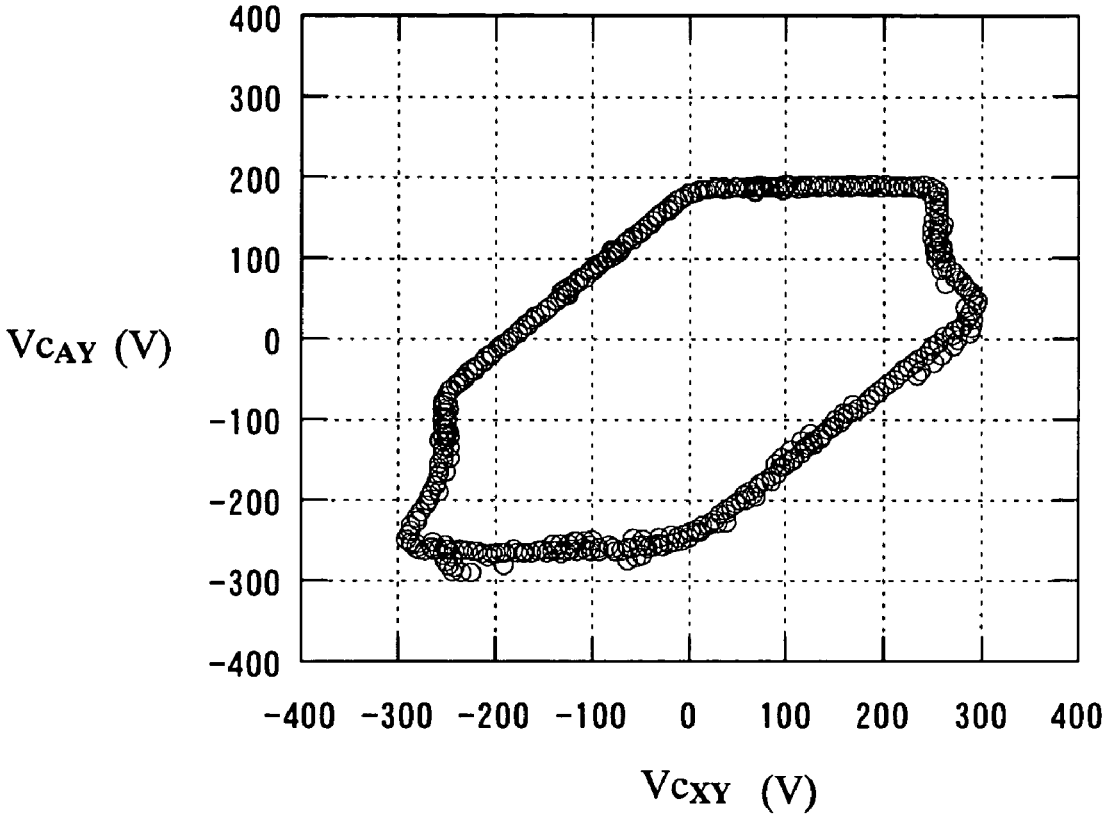
FIG. 8 is a diagram showing a measurement example of a Vt closed curve.

The vertex A: simultaneous discharge at the XY-interelectrode and the AY-interelectrode in which the display electrode Y is a common cathode The vertex B: simultaneous discharge at the AY-interelectrode and the AX-interelectrode in which the address electrode A is a common anode The vertex C: simultaneous discharge at the AX-interelectrode and the XY-interelectrode in which the display electrode X is a common cathode The vertex D: simultaneous discharge at the XY-interelectrode and the AY-interelectrode in which the display electrode Y is a common anode The vertex E: simultaneous discharge at the AY-interelectrode and the AX-interelectrode in which the address electrode A is a common cathode The vertex F: simultaneous discharge at the XA-interelectrode and the XY-interelectrode in which the display electrode X is a common anode FIG. 8 is a diagram showing a measurement example of a Vt closed curve. In FIG. 8, a portion that relates to XY discharge is not a straight line but a little distorted, though the Vt closed curve has a shape that is approximately a hexagon. Hereinafter, it is regarded that the Vt closed curve is a hexagon. Using the above-explained cell voltage plane and Vt closed curve, the operation of a cell when a blunt wave is applied will be clear.

[Analysis of Discharge]

Figure 9A:
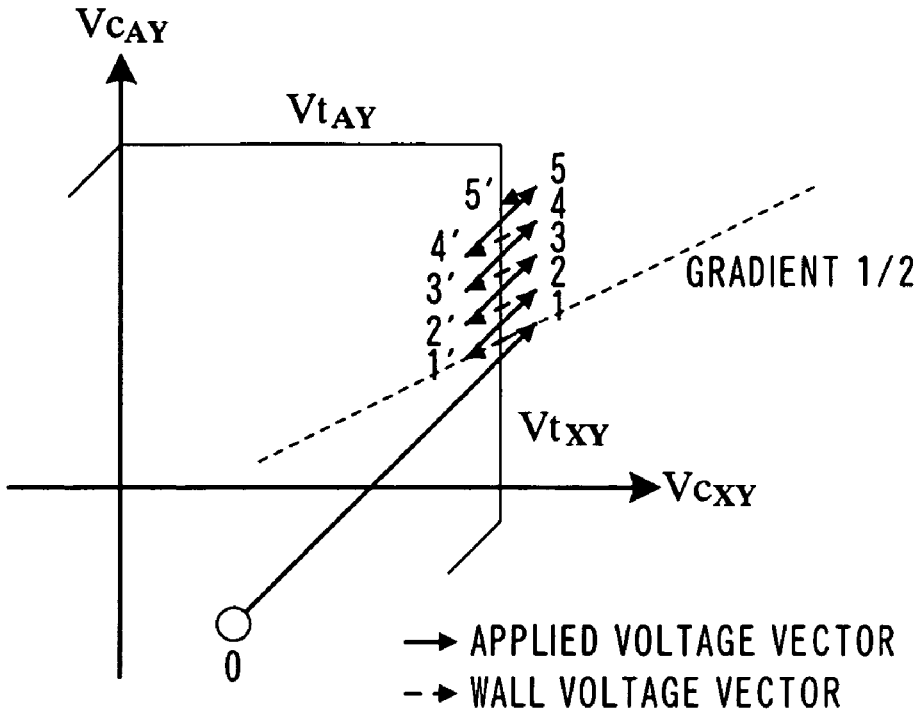
FIGS. 9A and 9B are diagrams showing an analysis of discharge generated by applying a blunt wave.
Figure 9B:
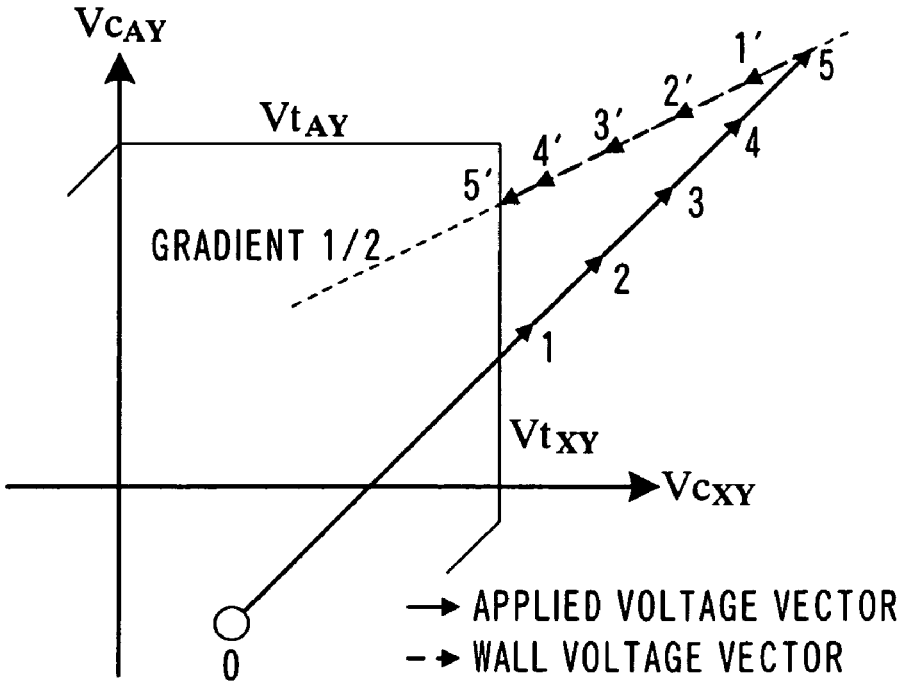

FIGS. 9A and 9B are diagrams showing an analysis of discharge generated by applying a blunt wave. Referring to FIGS. 9A and 9B, a method will be explained for deriving a wall voltage vector that varies in accordance with discharge when a blunt wave is applied from the cell voltage plane and the Vt closed curve.

In FIG. 9A, the point 0 is a cell voltage point just before when a blunt wave is applied. When the blunt wave is applied, the cell voltage point moves from the point 0 to the point 1. When the cell voltage point passes the Vt closed curve in this movement, the cell voltage at the XY-interelectrode exceeds the discharge start threshold level $Vt_{XY}$, so that the XY discharge is generated. In the discharge generated by applying the blunt wave, the wall voltage is written so that the cell voltage is maintained at the threshold level after the cell voltage once exceeds the threshold level. This writing process is shown by a wall voltage vector 11' (the start point is the point 1 while the end point is the point 1'). Since the blunt wave continues to increase until the voltage thereof reaches a peak value, an applied voltage vector 1'2 of the increase is added so that the cell voltage point moves from the point 1' to the point 2. Similar processes are repeated until the voltage of the blunt wave reaches a peak value. Since the XY discharge is generated, the charge moves mainly between the X electrode and the display electrode Y. Supposing that the wall charge moved to the X electrode by +Q and to the display electrode Y by −Q, the wall charge moves at the XY-interelectrode by Q−(−Q)=2Q and at the AY-interelectrode by −(−Q)=Q. Therefore, the writing direction due to the XY discharge has a gradient ½on the cell voltage plane that has coordinates as explained above. To be accurate, this gradient should be derived not from the wall charge but from the wall voltage, so it depends on a shape and a material of the dielectric layer covering the electrodes. However, since the gradient in the real measurement is nearly ½, the gradient in the analysis is approximated to ½.

A total amount of the cell voltage point when the application of one blunt wave is finished and the wall voltage variation when the blunt wave is applied can be derived geometrically as shown in FIG. 9B. The procedure is as follows. The applied voltage vector is applied in turn from the wall voltage point at the initial state as a starting point, so that a total applied voltage vector 05 is drawn. A straight line having the gradient ½and passing through the end point 5 of the total applied voltage vector 05 is drawn. Then, the diagram is checked. The intersection point 5' of the straight line having the gradient ½and the Vt closed curve is the cell voltage point after the movement, and the distance from the point 5 to the point 5' is the total sum of the wall voltage variation. A vector 55' in FIG. 9B corresponds to the total sum of the wall voltage vector in FIG. 9A. Here, it should be noted that the cell voltage really does not become a large value like the point 5 in FIG. 9B, but the cell voltage point moves a vicinity of the Vt closed curve as shown in FIG. 9A.

Although the XY discharge is exemplified in FIGS. 9A and 9B, the AX discharge and the AY discharge can be also analyzed in the same way. The XY discharge has the direction of the wall voltage vector that becomes the gradient ½, the AY discharge has the direction of the wall voltage vector that becomes the gradient 2, and the AX discharge has the direction of the wall voltage vector that becomes the gradient −1.

[Analysis of the Initialization Process in Which a Blunt Wave is Applied]

Figure 5:
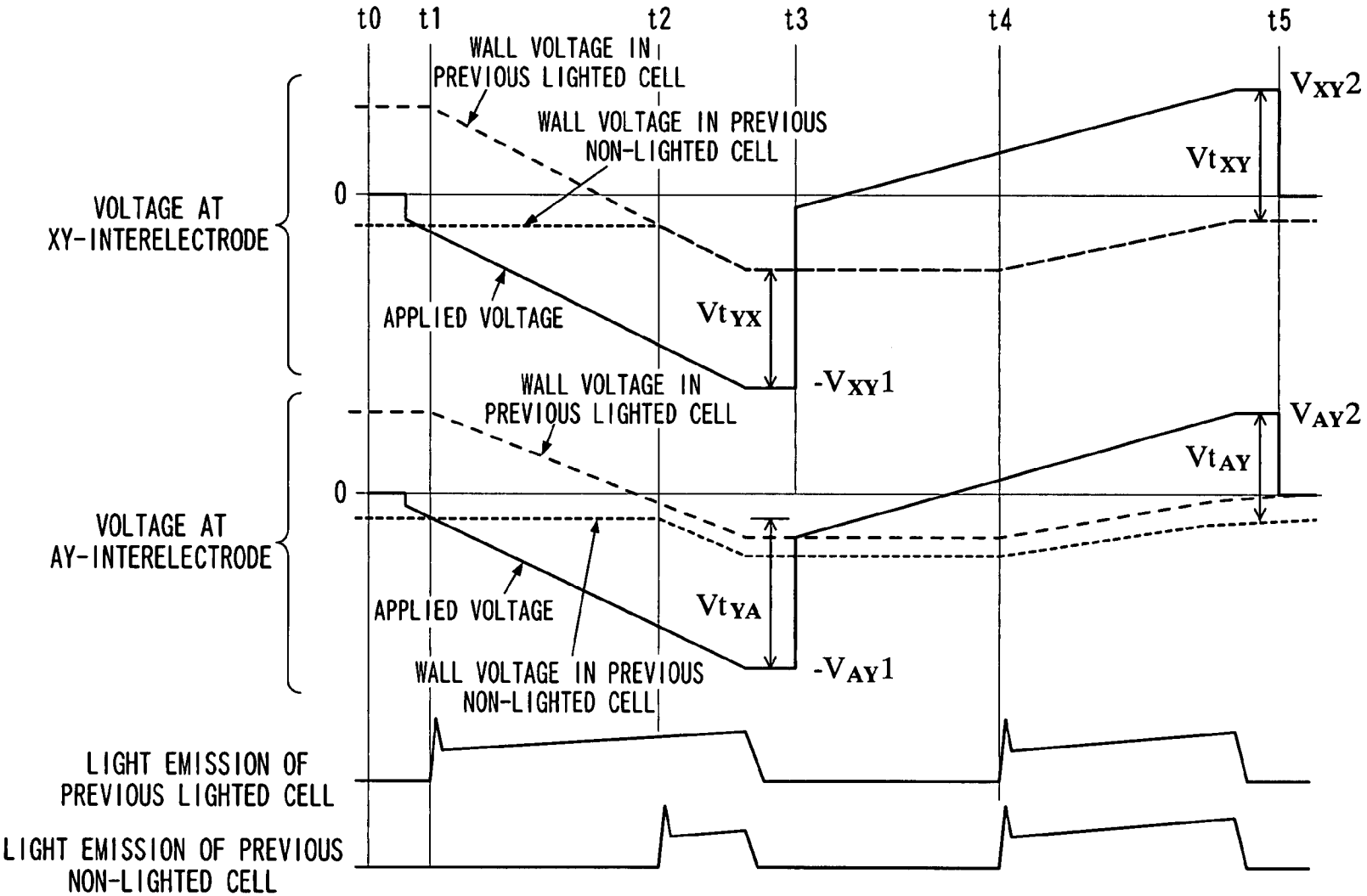
FIG. 5 PRIOR ART
FIG. 5 shows an example of a cell operation in the conventional initialization process.
Figure 10A:
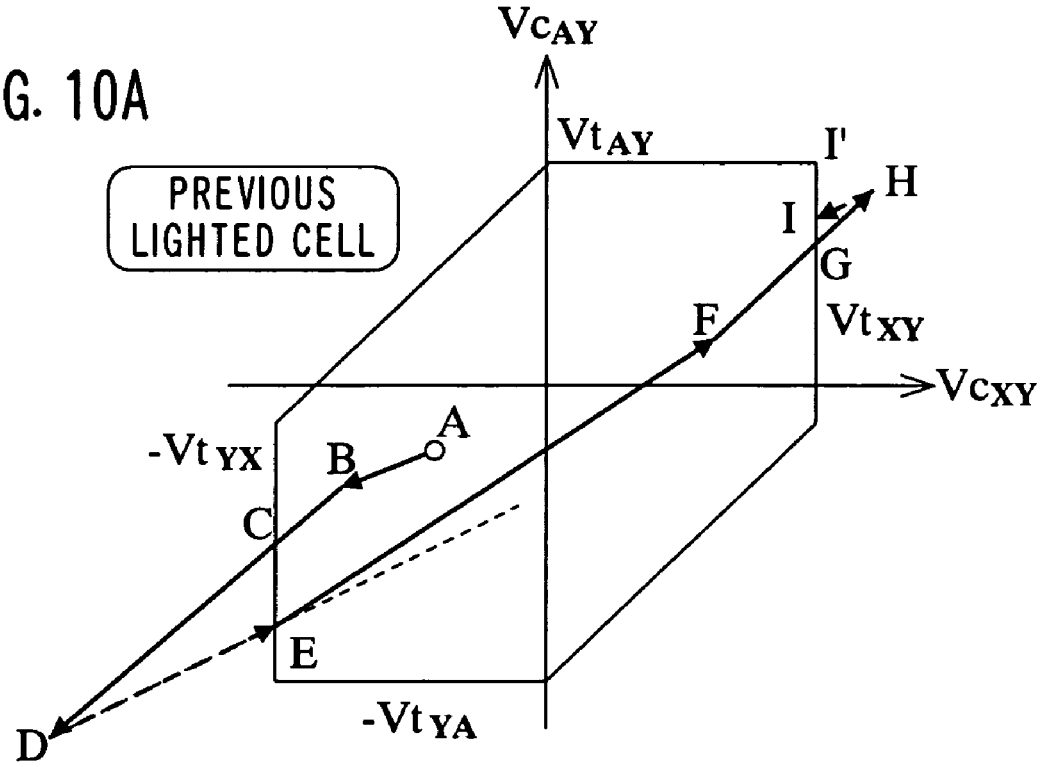
FIGS. 10A and 10B are diagrams showing an analysis of an initialization process in which a blunt wave is applied.
Figure 10B:
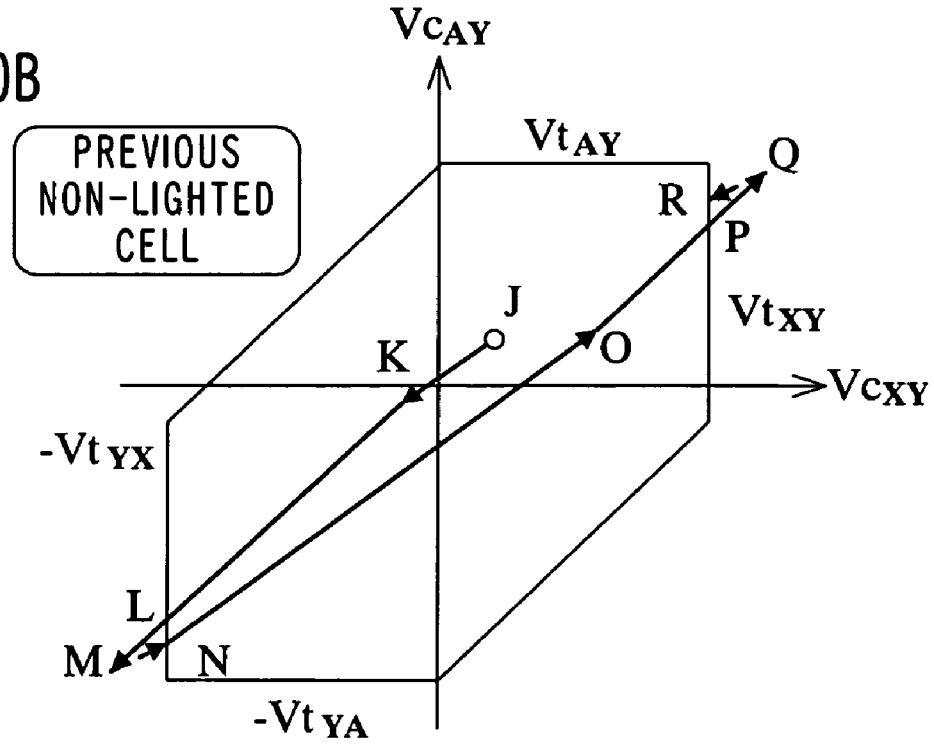

Referring to the above explanation, an analysis of the conventional operation that was shown in FIG. 5 will be tried. FIGS. 10A and 10B are diagrams showing an analysis of an initialization process in which a blunt wave is applied. FIG. 10A shows an analysis of an operation of a previous lighted cell while FIG. 10B shows an analysis of an operation of a previous non-lighted cell.

In FIG. 10A, the cell voltage point of the previous lighted cell at the start point of the initialization process is the point A. Since the applied voltage varies in a step-like manner at first in the initialization process according to the waveform shown in FIG. 5, the cell voltage point moves to the point B. When a negative blunt wave is applied, discharge starts at the point C so that the wall voltage is written. Since the discharge is the XY discharge, the writing direction has the gradient ½. The cell voltage point when the first blunt wave is finished is the point E. When the applied voltage varies rapidly at the time point of transition from the negative blunt wave to the positive blunt wave, the cell voltage point moves to the point F. When the positive blunt wave is applied, discharge starts at the point G so that the wall voltage is written. Since the discharge is the XY discharge, the wall voltage is written in the direction having the gradient ½. When the XY discharge begins, the cell voltage point moves upwardly along the Vt closed curve in FIG. 10A. This means that the cell voltage at the AY-interelectrode increases while maintaining the cell voltage at the XY-interelectrode at $Vt_{XY}$. In FIG. 10A, the cell voltage point when the application of the positive blunt wave is finished is the point I. Namely, in the case of the example of the operation shown in FIG. 5, although the cell voltage point moves along the Vt closed curve when the negative blunt wave and the positive blunt wave are applied, it does not move to the apex of the Vt closed curve finally but stops on a side that shows the XY discharge. Here, if the amplitude of the positive blunt wave is sufficiently large so that the cell voltage of the AY-interelectrode reaches the threshold level $Vt_{AY}$, discharge is generated at the XY-interelectrode and the AY-interelectrode simultaneously. While the simultaneous discharge continues, the wall voltage is written by the increase of the applied voltage. Accordingly, the cell voltage point is fixed to the simultaneous discharge point I'. The wall voltage at the XY-interelectrode as well as at the AY-interelectrode becomes a set value determined by the amplitude of the positive blunt wave and the threshold level $Vt_{AY}$.

In FIG. 10B, the cell voltage point of the previous non-lighted cell when the initialization process is started is the point J. Since the applied voltage varies in a step-like manner at first in the initialization step according to the waveform shown in FIG. 5, the cell voltage point moves to the point K. When the negative blunt wave is applied, discharge starts at the point L so that the wall voltage is written. Since the discharge is the XY discharge, the writing direction has the gradient ½. The cell voltage point when the application of the negative blunt wave is finished is the point N. When the applied voltage varies rapidly at the time point of transition from the negative blunt wave to the positive blunt wave, the cell voltage point moves to the point O. When the second blunt wave is applied, discharge begins at the point P so that the wall voltage is written. Since the discharge is the XY discharge, the wall voltage is written in the direction of the gradient ½. However, the cell voltage at the AY-interelectrode does not reach the threshold level $Vt_{AY}$ also in the previous non-lighted cell in the same way as in the previous lighted cell. The cell voltage point when the application of the positive blunt wave is finished is the point R that is not the simultaneous discharge point.

Hereinafter, among the six simultaneous discharge points explained above, the simultaneous discharge point that indicates the simultaneous discharge at the XY-interelectrode and the AY-interelectrode in which the display electrode Y is the cathode is called a "simultaneous initialization point".

Next, in order to achieve the object of the present invention, a wall voltage that is written by applying a blunt wave will be considered. First, a value of the wall voltage in the lighted cell during the sustaining period will be explained.

FIGS. 11A–11C are diagrams showing relationships between a typical sustaining pulse waveform and a wall voltage in a lighted cell. Here, the applied voltage to the address electrode A is zero. FIG. 11A shows a case where a pulse base potential is set to zero and a pulse having amplitude Vs is applied alternately to the display electrode X and the display electrode Y. FIG. 11B shows an example where a pulse having amplitude Vs/2 and a pulse having amplitude −Vs/2 are applied simultaneously to the display electrode X and the display electrode Y. FIG. 11C shows a case where a pulse having amplitude −Vs is applied alternately to the display electrode X and the display electrode Y. The voltage at the XY-interelectrode does not change among the cases shown in FIGS. 11A, 11B and 11C. The voltage at the AY-interelectrode has the same amplitude and different dc levels. The pulse base potential is not limited to zero. However, in a study about a sustaining operation line that will be explained below, it is sufficient to change an intercept in accordance with a value of the pulse base potential.

Figure 12:
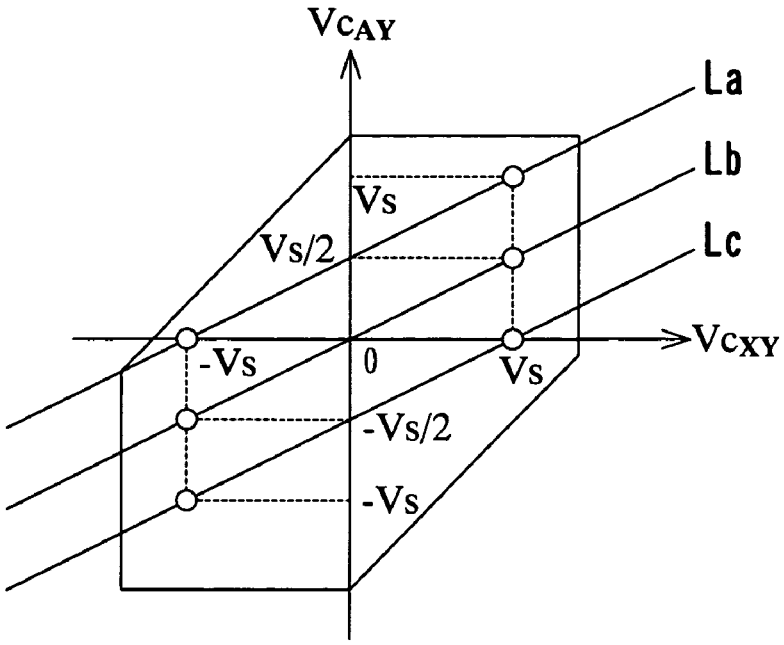
FIG. 12 is a diagram showing positions of wall voltage points during a sustaining period.

FIG. 12 is a diagram showing positions of wall voltage points during a sustaining period, which correspond to waveforms shown in FIG. 11. In each case shown in FIG. 11A, 11B or 11C, two wall voltage points exist. These points correspond to polarities of the applied voltage to the XY-interelectrode. Connection between the two wall voltage points makes a straight line having the gradient ½. The intercept of the straight line with the vertical axis corresponds to the offset of the wall voltage at the AY-interelectrode shown in FIG. 11. Hereinafter, this straight line is called a sustaining operation line. The wall voltage in the lighted cell is one of two points that are located on the sustaining operation line and symmetric to each other.

[Condition of Correct Initialization]

Figure 1:
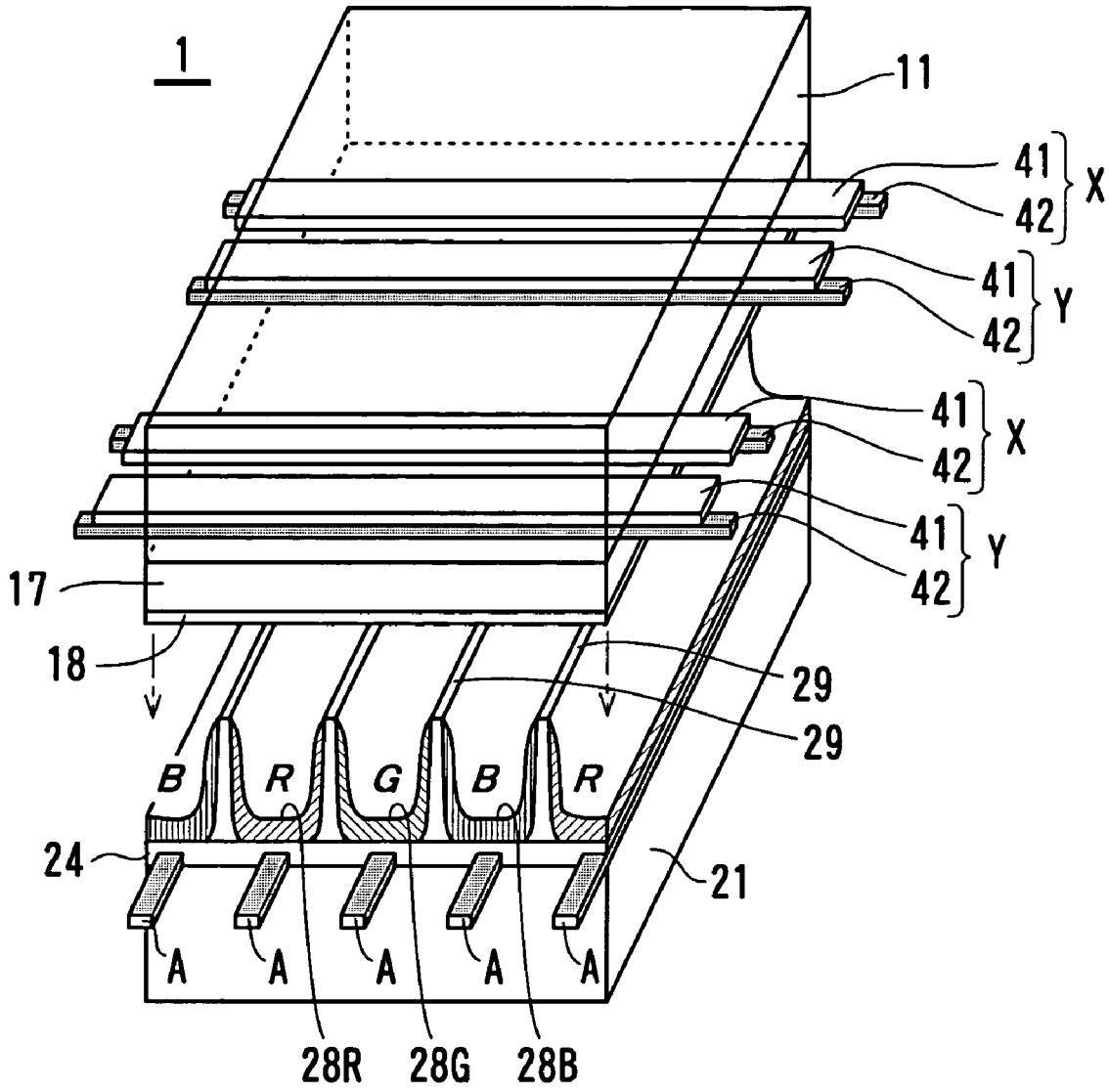
FIG. 1 PRIOR ART
FIG. 1 shows a cell structure of a typical surface discharge type plasma display panel.
Figure 2:
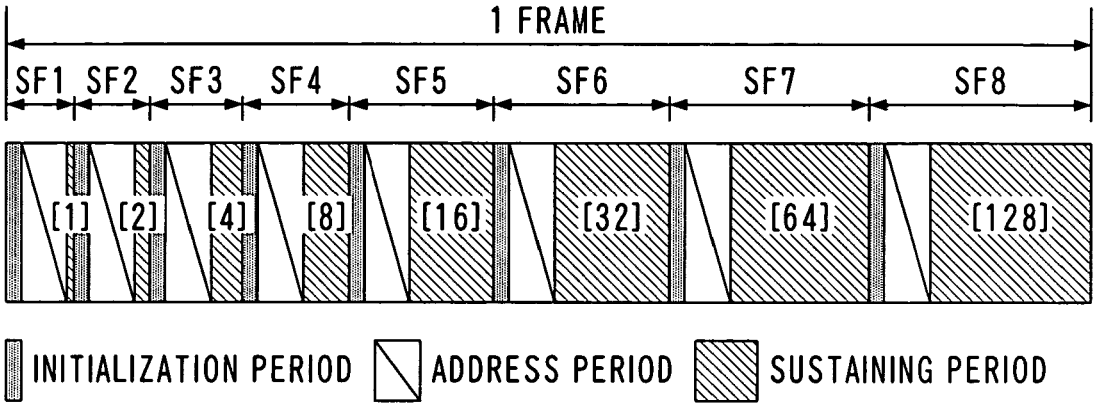
FIG. 2 PRIOR ART
FIG. 2 shows an example of frame division for a color display.
Figure 3:
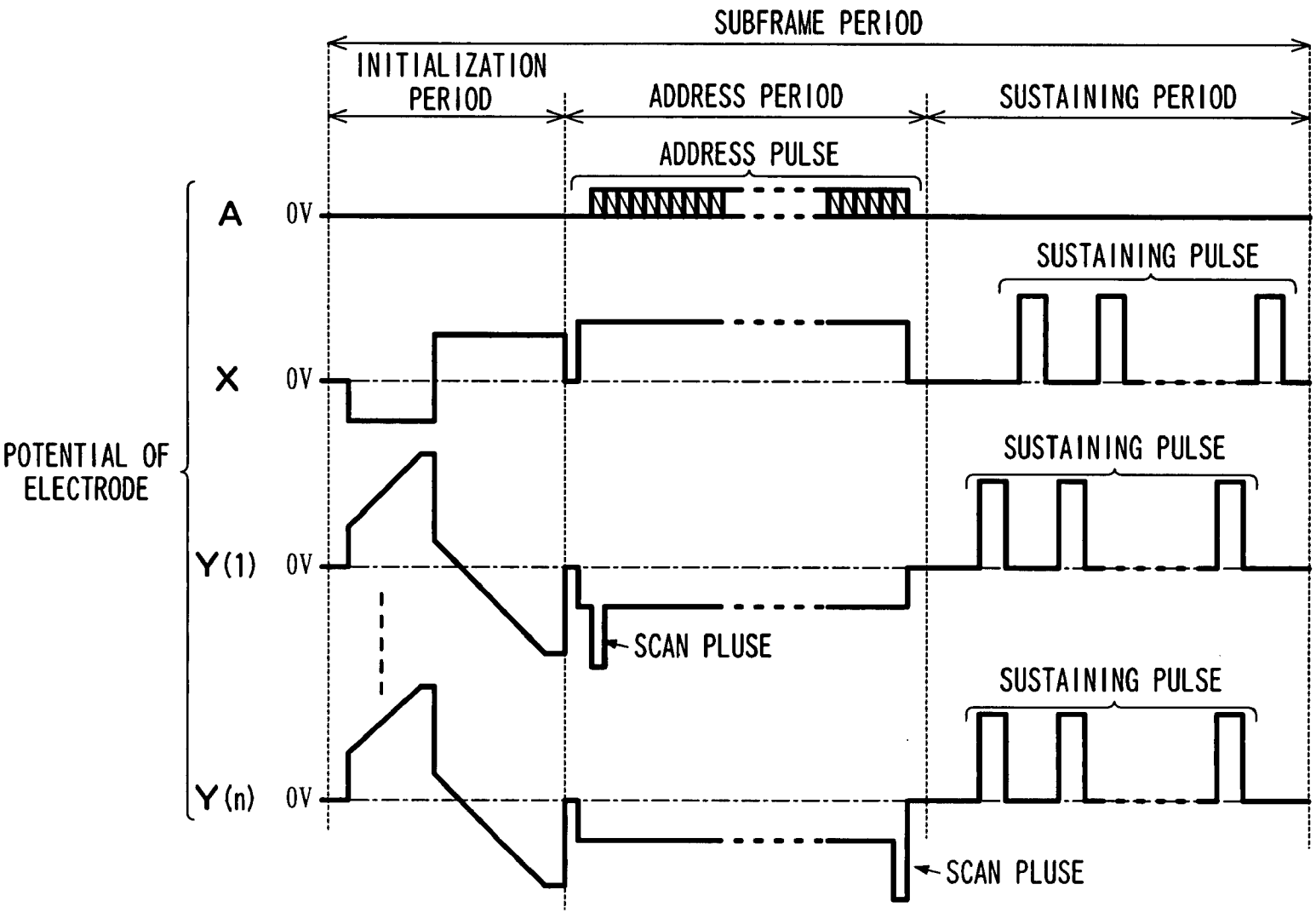
FIG. 3 PRIOR ART
FIG. 3 shows conventional driving waveforms.
Figure 4A:
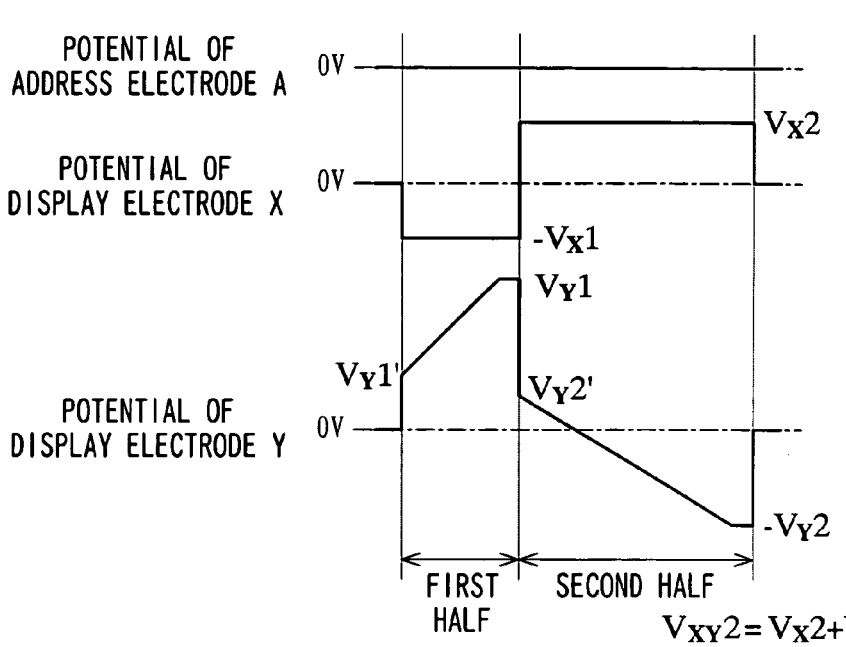
FIG. 4A PRIOR ART
FIGS. 4A and 4B show waveforms of voltage variation in the conventional initialization process.
Figure 4B:
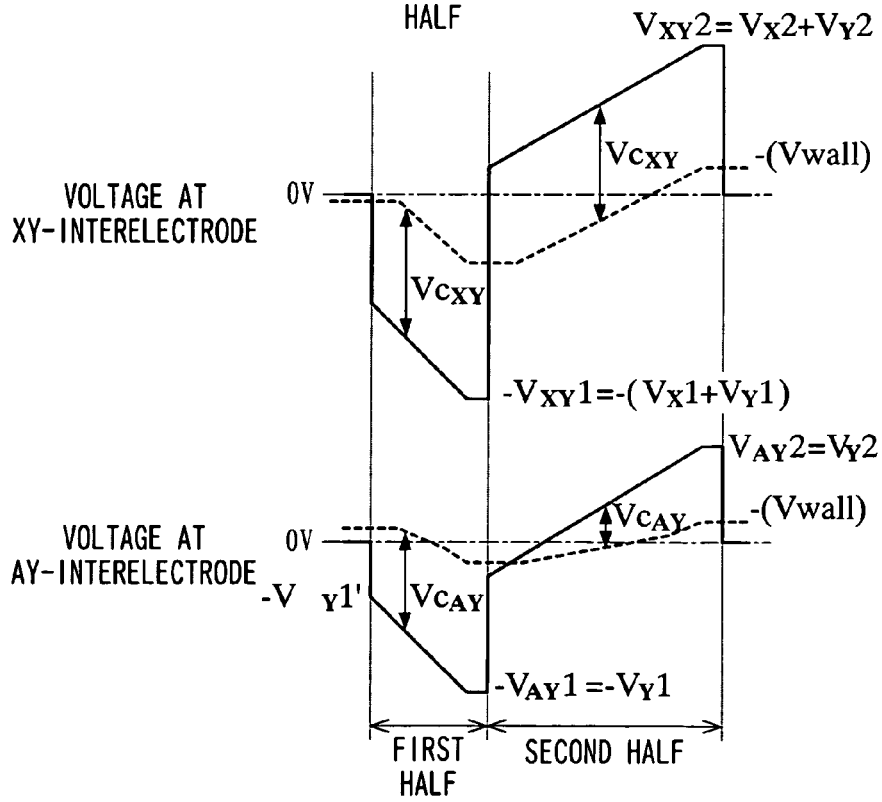
FIG. 4B PRIOR ART
Figure 13:
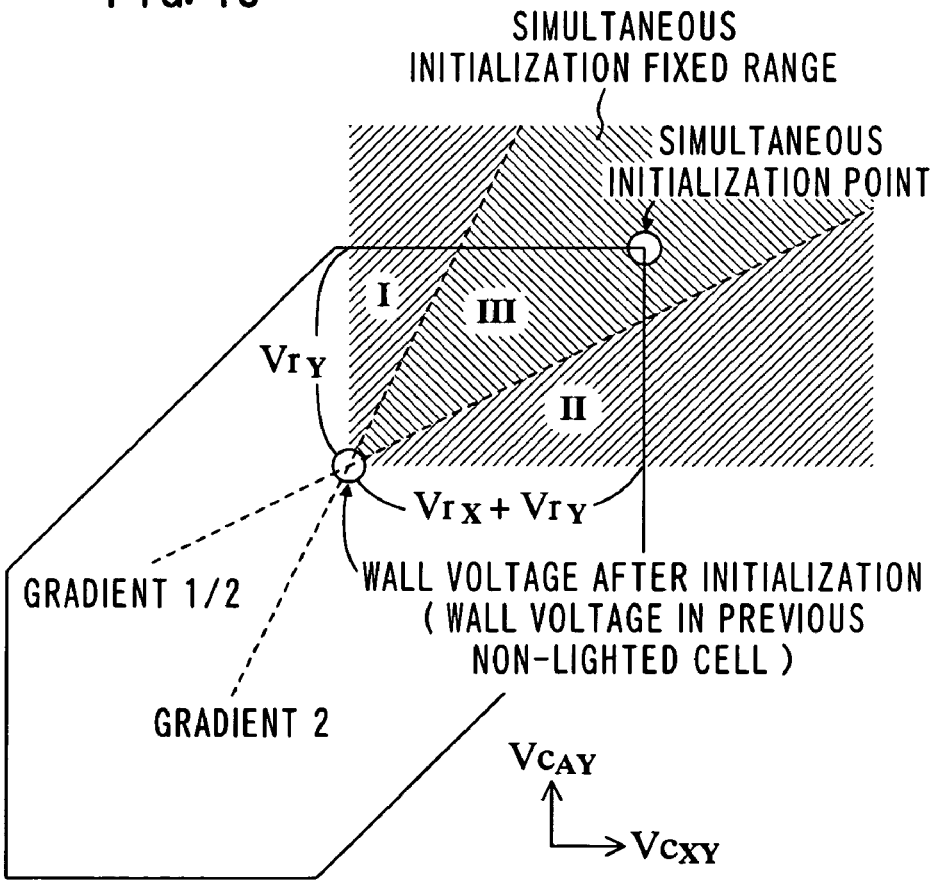
FIG. 13 is an explanatory diagram of a condition for a correct initialization process.

FIG. 13 is an explanatory diagram of a condition for a correct initialization process. Here, an initialization process is supposed in which the blunt wave is applied in two-step manner (see FIG. 3). The potential of the display electrode X is $+Vr_X$ and the potential of the display electrode Y is $-Vr_Y$ when the second application of the blunt wave is finished.

A desired initialization is an operation in which the cell voltage point when it is finished becomes the simultaneous initialization point. If the desired initialization is performed, the wall voltage point after the initialization is shifted from the simultaneous initialization point in the leftward direction by $Vr_X+Vr_Y$ and in the downward direction by $Vr_Y$. Since the wall voltage hardly changes during the address period and the sustaining period in the non-lighted cell, the wall voltage point in a previous non-lighted cell (a non-lighted cell in the previous subframe) is the simultaneous initialization point or vicinity thereof when the initialization is started as a preparation for the addressing in a subframe.

For appropriate initialization, discharge has to be generated by the last application of the blunt wave during the initialization period. The range that satisfies this condition is a range located at the upper right of the wall voltage point after the initialization. The discharge generated by the last application of the blunt wave can be classified into three cases including the case where it progresses to the simultaneous discharge, the case where it is only the XY discharge without progressing to the simultaneous discharge and the case where it is only the AY discharge without progressing to the simultaneous discharge. The ranges corresponding to these three cases are respectively indicated by III, II and I in FIG. 13. The three ranges are defined by two straight lines, one of which passes the wall voltage point after the initialization and has the gradient 2, and the other of which passes the same and has the gradient ½. It is only the range III in FIG. 13 in which a correct initialization is performed securely by the last application of the blunt wave. This range is called a "simultaneous initialization fixed range". In the initialization in which a blunt wave is applied two times, the simultaneous initialization fixed range is determined by the applied voltage of the second blunt wave. Therefore, in order to realize a desired initialization, both the wall voltage points in the previous lighted cell and in the previous non-lighted cell have to be moved to the simultaneous initialization fixed range before the second blunt wave is applied.

The initialization is performed securely only when the wall voltage point is moved to the range III in FIG. 13 before entering the second application of the blunt wave. This range is called a simultaneous initialization fixed range. In the two-stage initialization waveform including a first half blunt wave and a second half blunt wave, the wall voltage point has to be moved by the first half blunt wave to a point within the simultaneous initialization fixed range that is determined by the applied voltage amplitude of the second half blunt wave.

Figure 14:
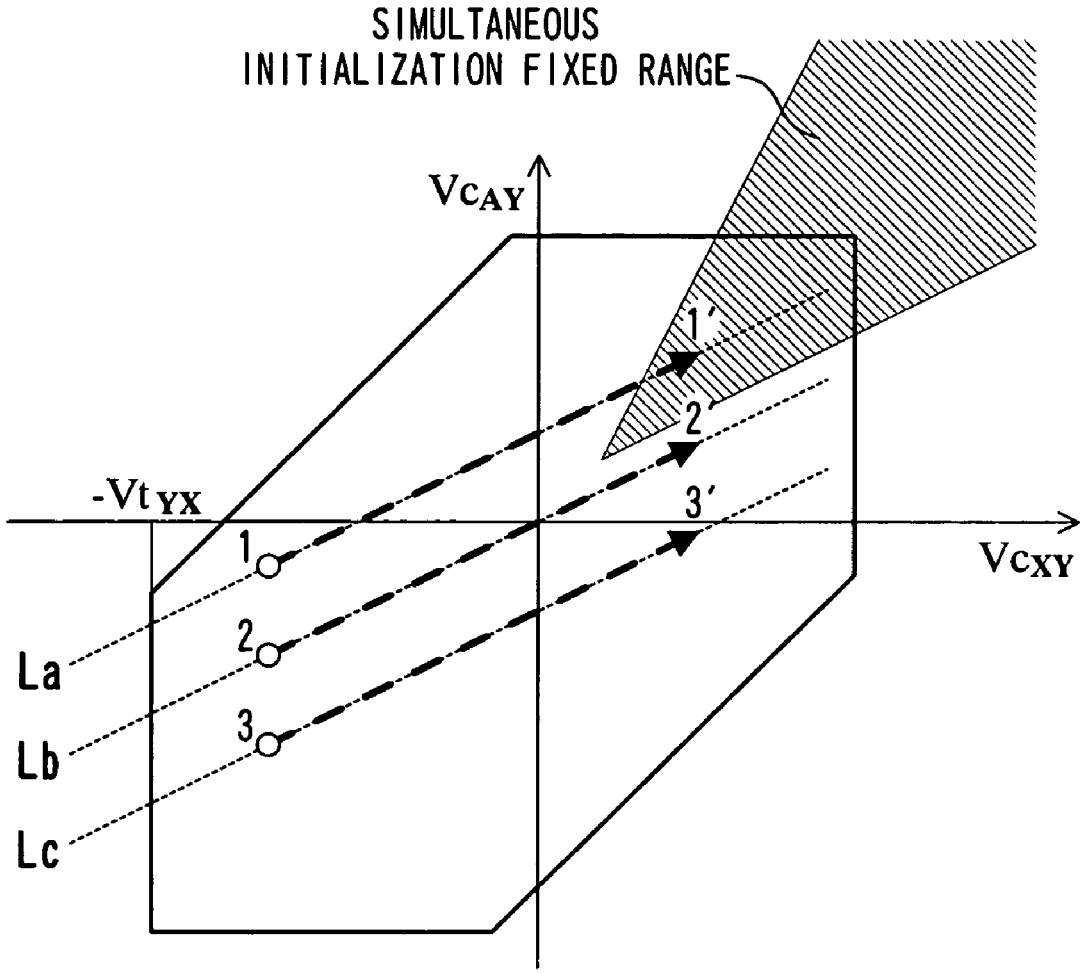
FIG. 14 shows a variation of a state of a previous lighted cell due to discharge at a XY-interelectrode when a blunt wave is applied first time.

FIG. 14 shows a variation of a state of a previous lighted cell due to discharge at the XY-interelectrode when a blunt wave is applied first time. In the case where the cell voltage point moves along the sustaining operation line La, the wall voltage point can be moved from the point 1 to the point 1' within the simultaneous initialization fixed range since the sustaining operation line La crosses the simultaneous initialization fixed range. On the contrary, in the case where the cell voltage point moves along the sustaining operation line Lb or the sustaining operation line Lc, the wall voltage point can be merely moved from the point 2 or 3 to the point 2' or 3' outside the simultaneous initialization fixed range only by the XY discharge since the sustaining operation lines Lb and Lc do not cross the simultaneous initialization fixed range.

There are two solutions for this problem. One is the method of increasing the applied voltage of the first blunt wave so that the simultaneous discharge is generated at the XY-interelectrode and the AY-interelectrode when the first blunt wave is applied. Another method is to increase the applied voltage of the second blunt wave so that the simultaneous initialization fixed range is enlarged to cross the sustaining operation line. These methods are effective for the initialization of the previous lighted cell. However, both the methods increase the applied voltage, so the light emission quantity in the previous non-lighted cell increases, and contrast is decreased.

[Initialization by the Driving Method According to the Present Invention]

Figure 15:
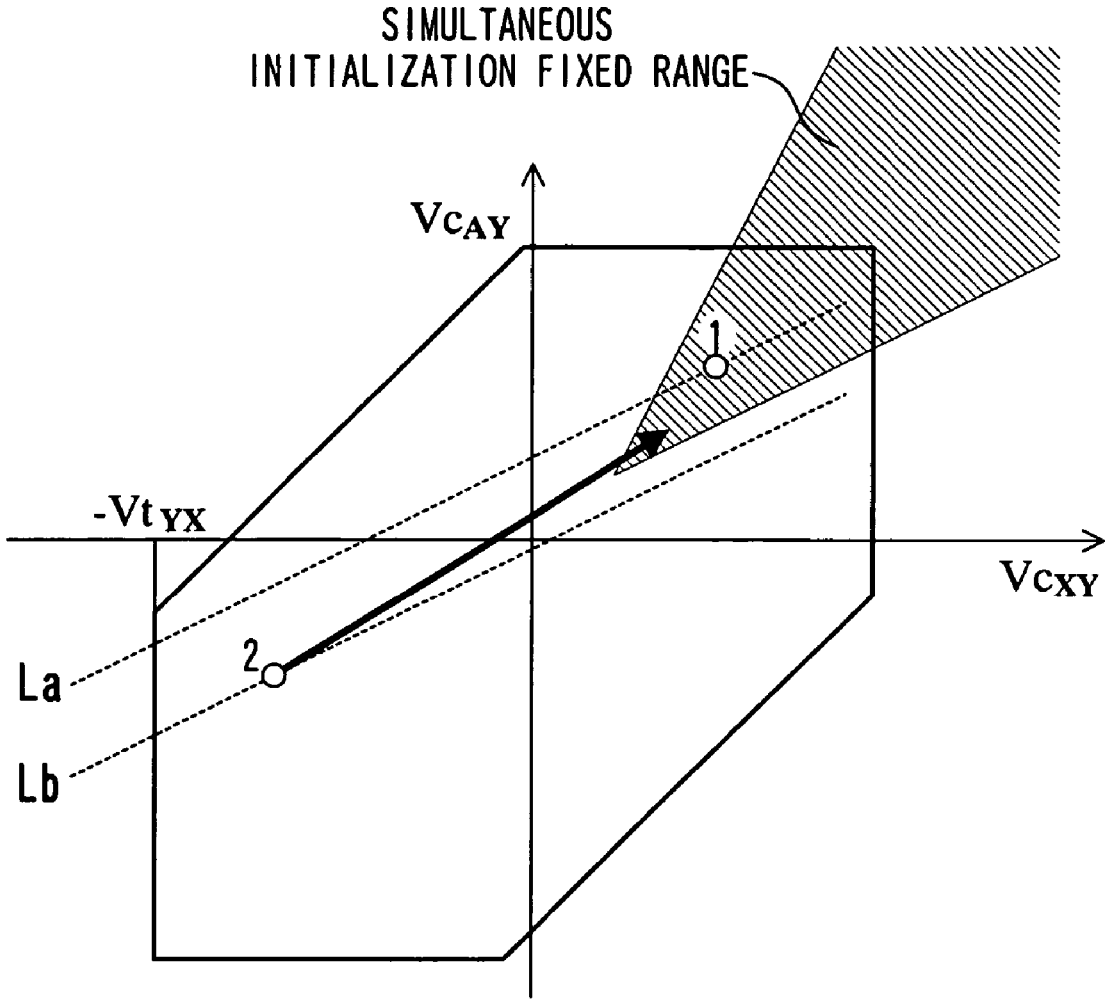
FIG. 15 is a diagram showing a principle of the present invention.

FIG. 15 shows a principle of the present invention.

The sustaining operation line La crosses the simultaneous initialization fixed range. In this case, it is sufficient to apply a sustaining pulse so as to make the last discharge during the sustaining period be discharge in which the display electrode X becomes a cathode and the display electrode Y becomes an anode. Thus, the cell voltage point is automatically included in the simultaneous initialization fixed range when the sustaining operation is finished.

The sustaining operation line Lb does not cross the simultaneous initialization fixed range. In this case, before the first application of the blunt wave, a rectangular pulse voltage is applied to the XY-interelectrode and the AY-interelectrode so that pulse discharge is generated in which the display electrode Y is a cathode. The pulse discharge moves the wall voltage point (the point 2) of the previous lighted cell to the simultaneous initialization fixed range. As a result, discharge is not generated by the first application of the blunt wave, but the simultaneous discharge is generated by the second application of the blunt wave in the previous lighted cell. On the other hand in the previous non-lighted cell, discharge is not generated by the application of the sustaining pulse and the rectangular pulse for initialization, but the simultaneous discharge is generated by the first and the second applications of the blunt wave.

EXAMPLE 1

Figure 16:
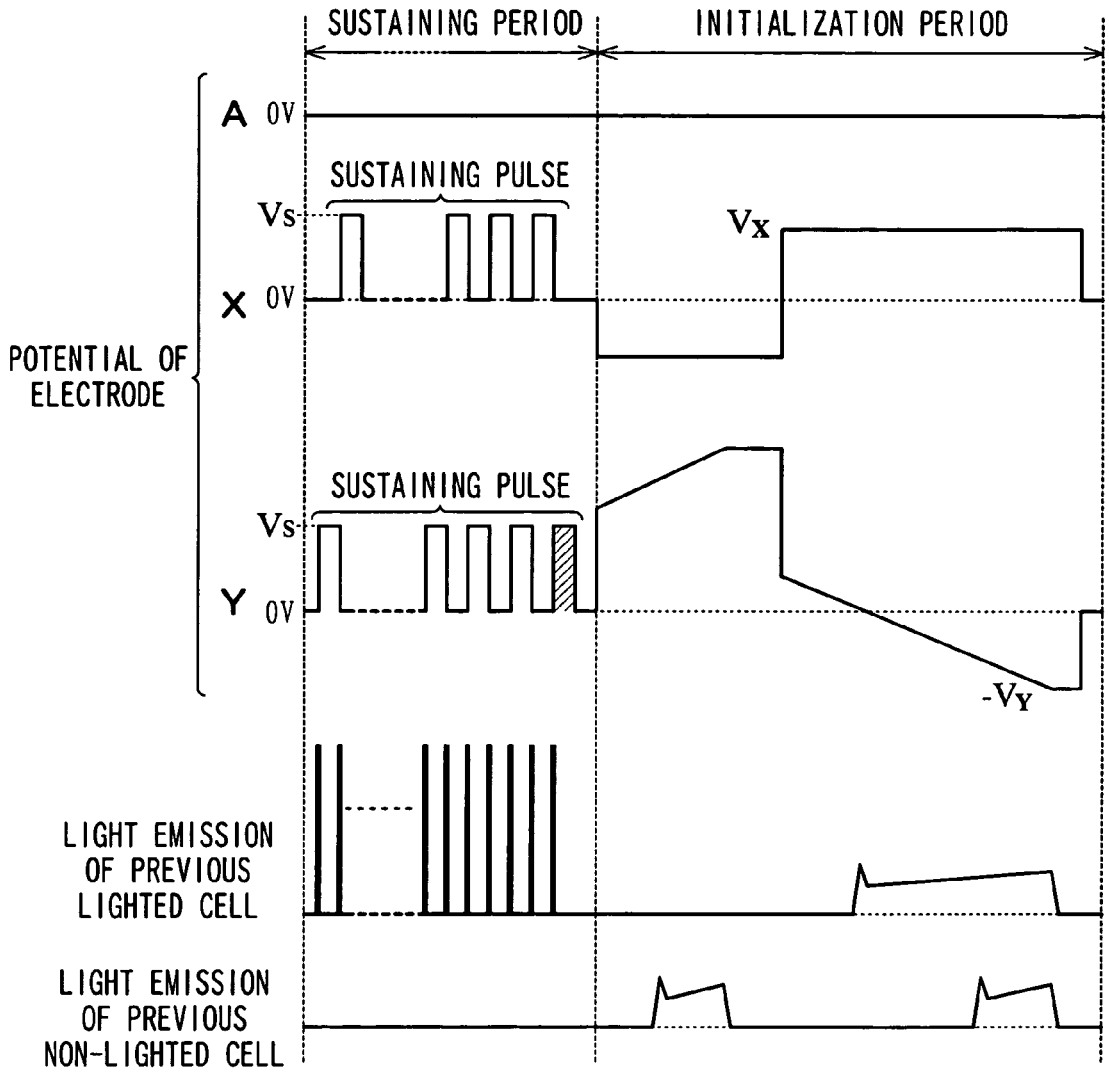
FIG. 16 shows a first example of driving waveforms.

FIG. 16 shows a first example of driving waveforms. The sustaining pulse having the amplitude Vs is applied alternately to the display electrode Y and the display electrode X during the sustaining period. The last sustaining pulse that is hatched in FIG. 16 is applied to the display electrode Y. During the sustaining period, the potential of the address electrode A is maintained at zero. The intercept of the sustaining operation line in this example is Vs/2. During the initialization period, the blunt wave is applied two times to three interelectrodes of each cell. When the second application of the blunt wave is finished, the potential of the display electrode X is $V_X$, and the potential of the display electrode Y is $-V_Y$. Therefore, the wall voltage point after the initialization is finished is a point of the coordinates ($Vt_{XY}-V_X$, $Vt_{AY}-V_Y$). If this point is located below the sustaining operation line, the sustaining operation line crosses the simultaneous initialization fixed range. Namely, if the driving waveform satisfies the voltage condition ($2Vt_{AY}-Vt_{XY} \leqq V_Y-V_X+VS$) so that the last sustaining pulse during the sustaining period generates the display discharge in which the display electrode Y becomes an anode as shown in FIG. 16, the lighted cell wall voltage point is located within the simultaneous initialization fixed range when the sustaining period ends. The voltage condition mentioned above is equal to the following expression.

$$2Vt_{AY}-Vt_{XY} \leqq 2V_{AY}-V_{XY}-2Va_{off}$$

Here, $V_{AY}$ represents a final voltage at the AY-interelectrode when the blunt wave is applied, $V_{XY}$ represents a final voltage at the XY-interelectrode when the blunt wave is applied, and $Va_{off}$ represents a difference between the potential of the address electrode A and the potential of the display electrode Y when display discharge is generated in the operation during the sustaining period.

The previous lighted cell does not generate discharge by the first application of the blunt wave, but the simultaneous discharge is generated by the second application of the blunt wave during the initialization period. The previous non-lighted cell generates discharge when the blunt wave is applied the first time as well as the second time.

It is not necessary to increase the amplitude of the first blunt wave, but the minimum value thereof is sufficient so that the previous non-lighted cell is initialized in a stable manner. The light emission of the previous non-lighted cell can be controlled to the minimum value so that a desired initialization can be realized without lowering the contrast.

EXAMPLE 2

Figure 17:
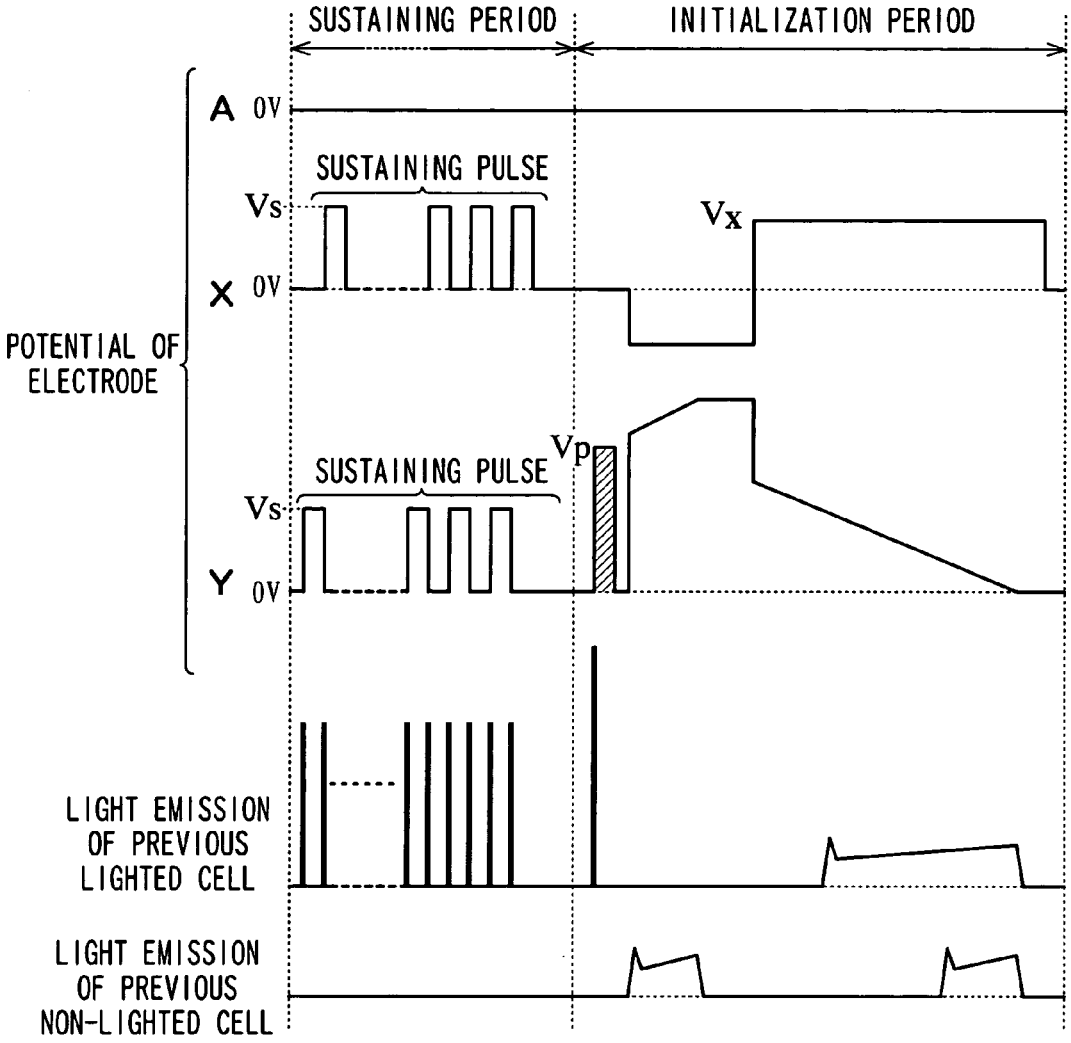
FIG. 17 shows a second example of driving waveforms.

FIG. 17 shows a second example of driving waveforms. During the sustaining period, the sustaining pulse of the amplitude Vs is applied alternately to the display electrode Y and the display electrode X. The last sustaining pulse is applied to the display electrode X. During the sustaining period, the potential of the address electrode A is maintained at zero. The intercept of the sustaining operation line in this example is Vs/2. During the initialization period, the rectangular waveform is applied one time and the blunt wave is applied two times to three interelectrodes of each cell.

When a rectangular pulse is used for the initialization, it is not necessary that the sustaining operation line cross the simultaneous initialization fixed range. Therefore, the second blunt wave during the initialization period ends at zero potential in this example. When the rectangular pulse having the amplitude Vp and the positive polarity is applied to the display electrode Y, pulse discharge is generated in which the display electrode Y is an anode so that the wall voltage point of the previous lighted cell moves to the simultaneous initialization fixed range. The previous lighted cell does not generate discharge by the first application of the blunt wave but generates the simultaneous discharge by the second application of the blunt wave during the initialization period. The previous non-lighted cell generates discharge by each of the first application and the second application of the blunt wave.

It is not necessary to increase the amplitude of the first blunt wave, but the minimum value thereof is sufficient so that the previous non-lighted cell is initialized in a stable manner. The light emission of the previous non-lighted cell can be controlled to the minimum value so that a desired initialization can be realized without lowering the contrast.

EXAMPLE 3

Figure 18:
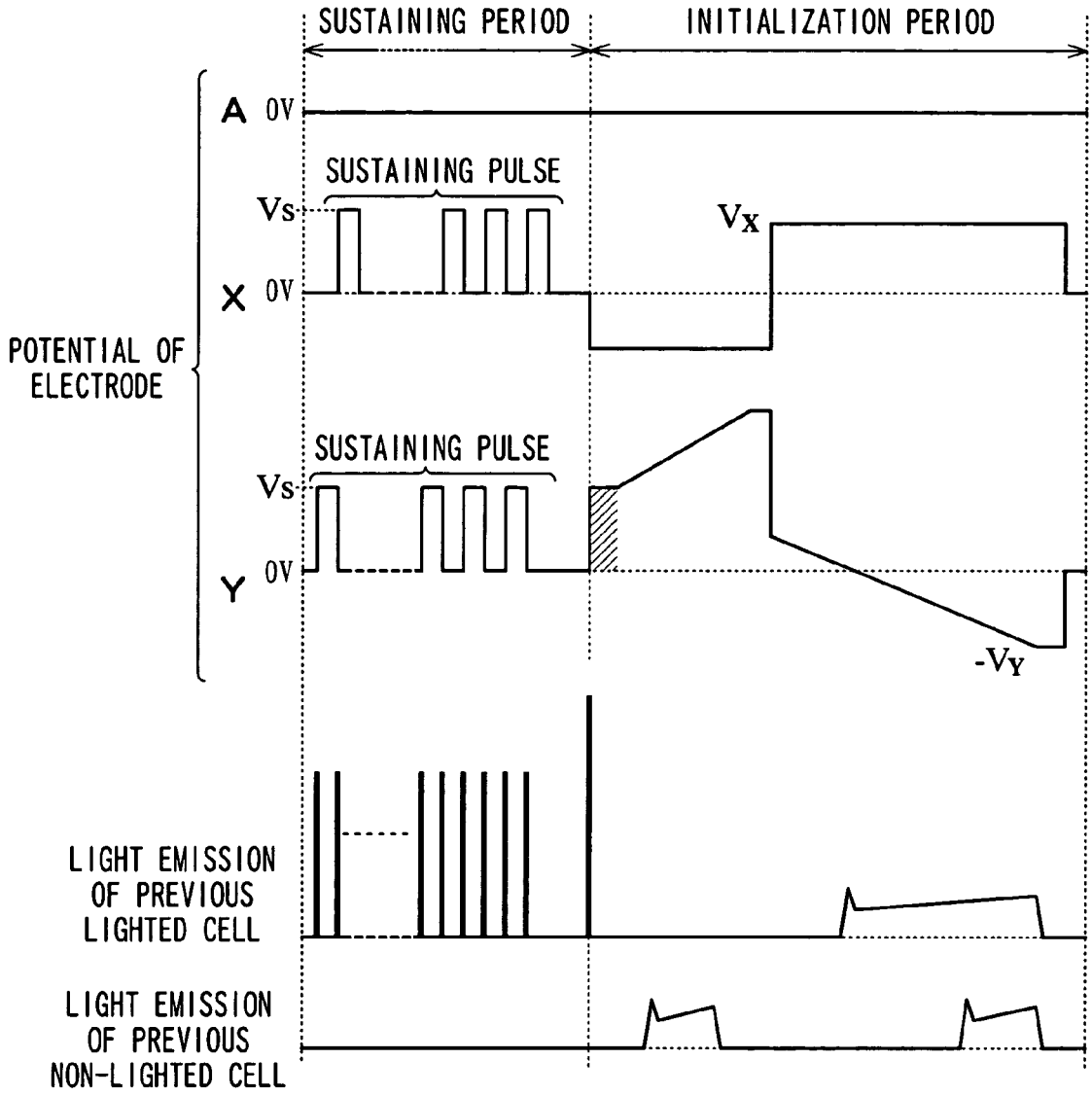
FIG. 18 shows a third example of driving waveforms.

FIG. 18 shows a third example of driving waveforms. In the third example, the useless voltage variation between the rectangular pulse and the first blunt wave in the initialization that exists in the second example is eliminated. Adding to the effect of the first and the second examples, another effect that the initialization period is shortened can be obtained by the third example.

EXAMPLE 4

Figure 19:
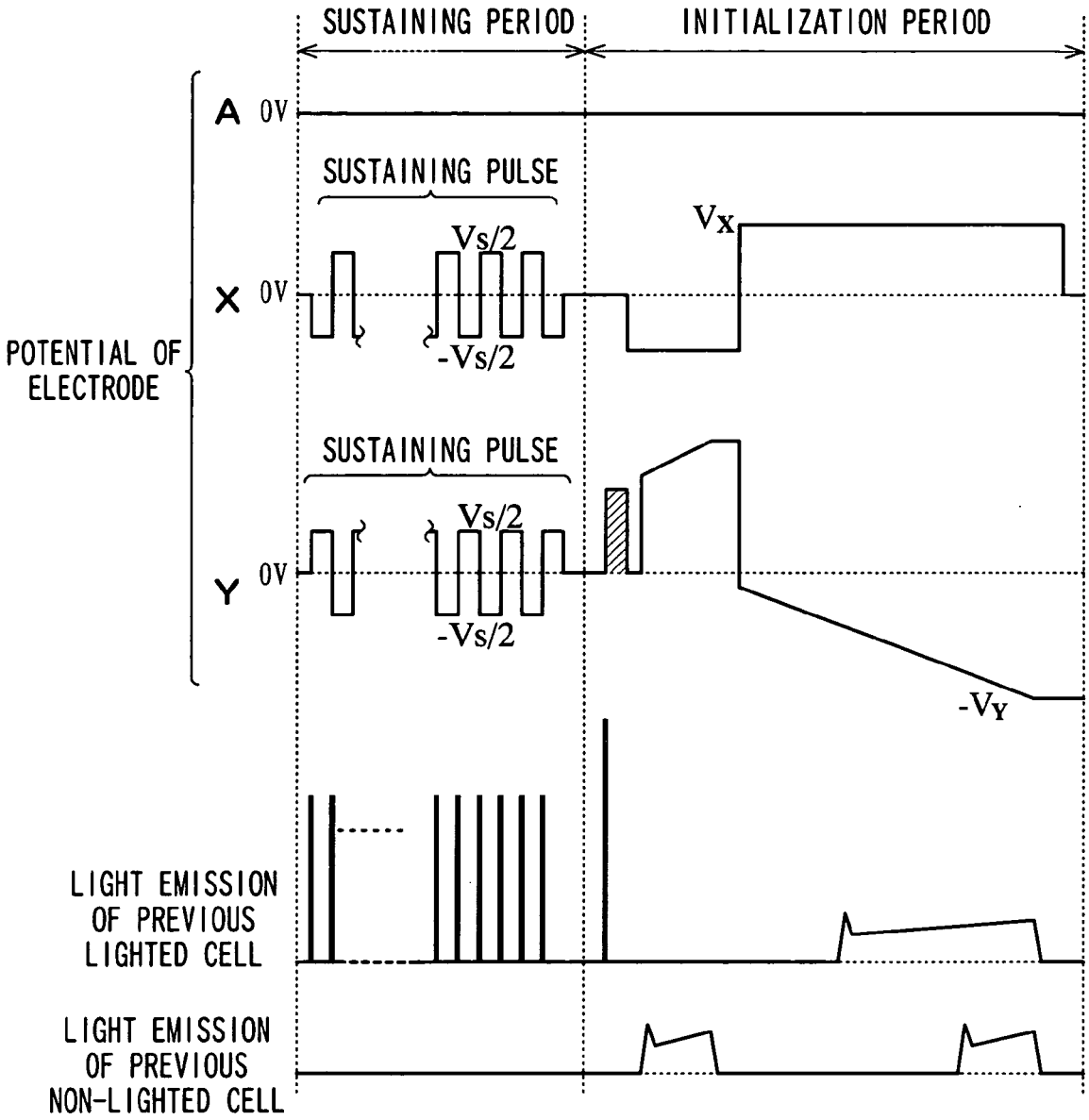
FIG. 19 shows a fourth example of driving waveforms.

FIG. 19 shows a fourth example of driving waveforms. During the sustaining period, the sustaining pulse of the voltage Vs/2 and the sustaining pulse of the voltage −Vs/2 are applied simultaneously to the display electrode Y and the display electrode X. The final display discharge is discharge in which the display electrode Y is a cathode. During the sustaining period, the potential of the address electrode A is maintained at zero. The intercept of the sustaining operation line in this example is zero. During the initialization period, the rectangular waveform is applied one time and the blunt wave is applied two times to three interelectrodes of each cell. The fourth example has the same effect as the first and the second examples.

EXAMPLE 5

Figure 20:
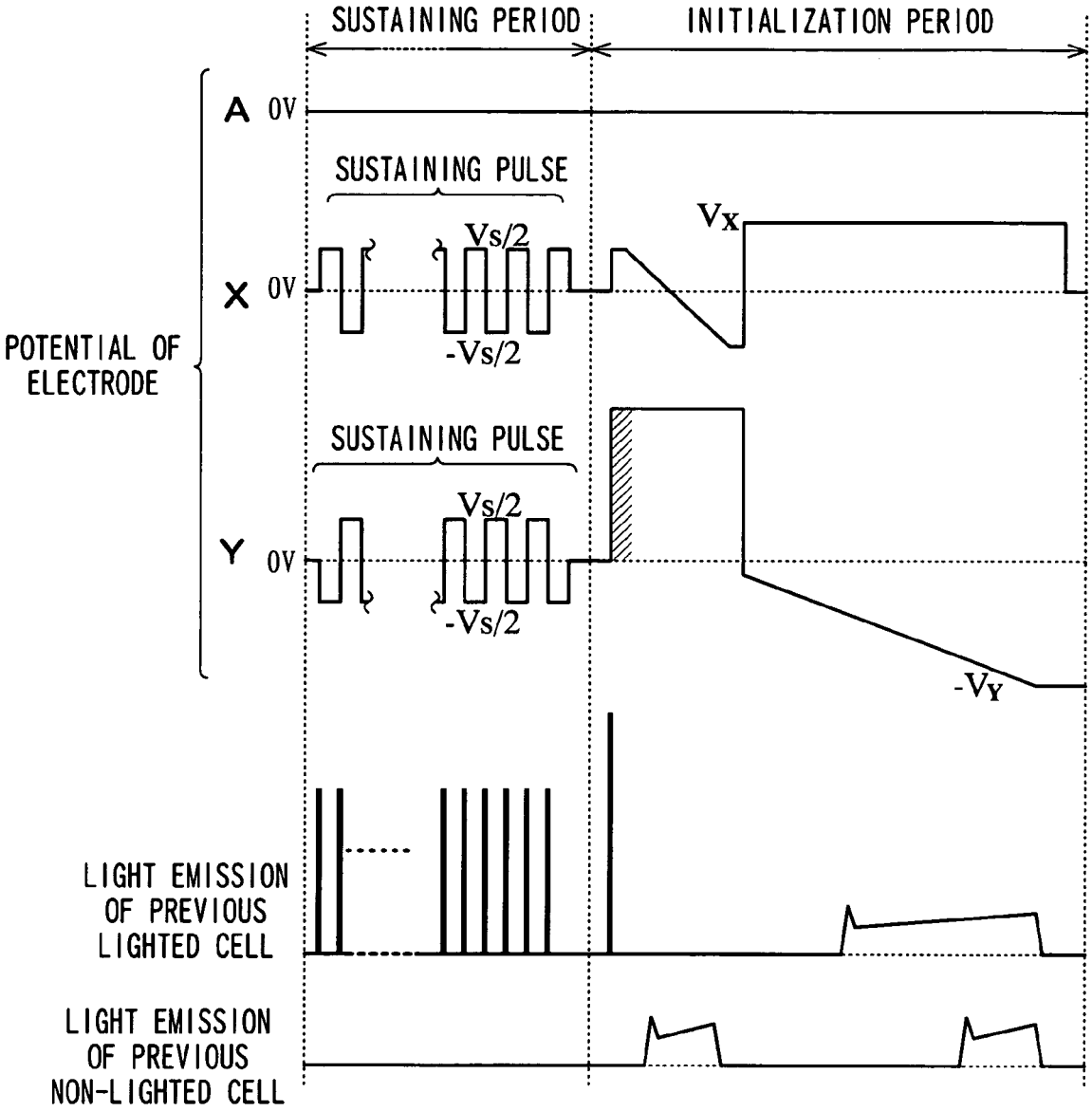
FIG. 20 shows a fifth example of driving waveforms.

FIG. 20 shows a fifth example of driving waveforms. During the sustaining period, a pulse is applied in the same way as in the fourth example. The waveform during the initialization period is a variation of the third example. The application of the rectangular waveform and the application of the first blunt wave to the interelectrode can be realized by applying a wide rectangular pulse to the display electrode Y and by applying a ramp wave pulse to the display electrode X.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for driving a three-electrode surface discharge AC type plasma display panel that has a screen in which first display electrodes, second display electrodes and address electrodes are arranged, the method comprising:

repeating initialization for equalizing wall voltages in all cells that constitute the screen, addressing for setting the wall voltage of each cell to a value corresponding to relevant display data in accordance with display data, and sustaining for generating display discharge a predetermined number of times only in cells to be lighted;

applying a blunt wave at least two times as the initialization operation so that a potential of at least one electrode of all the cells increases or decreases simply;

generating discharge only in a previous non-lighted cell that was not lighted in the last sustaining process that was performed before the initialization so that the wall voltage thereof approaches a wall voltage of a previous lighted cell that was lighted in the last sustaining process, in the first blunt wave application among the at least two blunt wave applications; and generating discharge in the previous lighted cell and the previous non-lighted cell so that the wall voltage of these cells change to set values, in the second blunt wave application.

2. The method according to claim 1, further comprising selecting cells by the second display electrode and the address electrode in the addressing; and generating discharge between display electrodes in which the second display electrode becomes a cathode and generating discharge between the second display electrode and the address electrode in the previous lighted cell and the previous non-lighted cell, in the second blunt wave application in the initialization.

3. The method according to claim 1, wherein the final display discharge in the sustaining process is made discharge in which the second display electrode is an anode, and the second blunt wave application in the initialization is performed so as to satisfy the following inequality, $$2Vt_{AY}-Vt_{XY}\leq 2V_{AY}-V_{XY}-2Va_{off},$$

where $Vt_{AY}$ represents a discharge start threshold level voltage when discharge in which the second display electrode becomes a cathode is generated between the second display electrode and the address electrode, $Vt_{XY}$ represents a discharge start threshold level voltage when discharge in which the second display electrode becomes a cathode is generated between the first display electrode and the second display electrode, $V_{AY}$ represents a final voltage between the second display electrode and the address electrode in the blunt wave application, $V_{XY}$ represents a final voltage between the first display electrode and the second display electrode in the blunt wave application, and $Va_{off}$ represents a dc component of an alternating pulse that is a difference between a potential of the address electrode and a potential of the second display electrode when display discharge is generated in the sustaining process.

4. The method according to claim 1, wherein adding to the two blunt wave applications as the initialization operation, a rectangular waveform is applied so as to increase or decrease a potential of at least one electrode of all the cells so that pulse discharge is generated, the rectangular waveform application is performed before the first blunt wave application, and in the rectangular waveform application, discharge is generated only in the previous lighted cell so that the wall voltage thereof approaches a wall voltage of a previous lighted cell that was lighted in the final sustaining process.

5. The method according to claim 4, wherein the last display discharge in the sustaining process is made discharge in which the first display electrode becomes an anode.

6. The method according to claim 4, wherein the rectangular waveform application and the first blunt wave application are performed continuously so that an electrode potential does not change between them.

* * * * *

UNITED STATES PATENT AND TRADEMARK OFFICE

CERTIFICATE OF CORRECTION

PATENT NO. : 7,145,524 B2
APPLICATION NO. : 10/765854
DATED : December 5, 2006
INVENTOR(S) : Koichi Sakita It is certified that error appears in the above-identified patent and that said Letters Patent is hereby corrected as shown below:

Column 14, Line 18, change "$2Va_{off,}$" to --$2Va_{off}$,--.

Column 14, Line 24, change "$Vt_{xy}$represents" to --$Vt_{xy}$ represents--.

Signed and Sealed this

First Day of May, 2007

JON W. DUDAS
*Director of the United States Patent and Trademark Office*